US010551137B2

(12) United States Patent
Hudson, III et al.

(10) Patent No.: US 10,551,137 B2
(45) **Date of Patent: *Feb. 4, 2020**

(54) SEMI-AUTOMATIC PISTOL

(71) Applicant: Billie Cyril Hudson, III, Georgetown, TX (US)

(72) Inventors: Billie Cyril Hudson, III, Georgetown, TX (US); Eugene Cannon Kane, II, North Canton, OH (US)

( * ) Notice: Subject to any disclaimer, the term of this patent is extended or adjusted under 35 U.S.C. 154(b) by 38 days.

This patent is subject to a terminal disclaimer.

(21) Appl. No.: 15/882,701

(22) Filed: Jan. 29, 2018

(65) Prior Publication Data

US 2018/0238647 A1 Aug. 23, 2018

(51) Int. Cl.

| | |
|---|---|
| ***F41A 21/00*** | (2006.01) |
| ***F41A 3/86*** | (2006.01) |
| ***F41A 19/10*** | (2006.01) |
| ***F41A 3/66*** | (2006.01) |
| ***F41C 3/00*** | (2006.01) |

(52) U.S. Cl.

CPC ..... *F41A 3/86* (2013.01); *F41A 3/66* (2013.01); *F41A 19/10* (2013.01); *F41C 3/00* (2013.01)

(58) Field of Classification Search

CPC .... F41A 3/86; F41A 3/66; F41A 19/10; F41C 3/00

USPC ..... 42/1.06, 16, 17, 18, 19, 28; 89/198, 163, 89/171, 185

See application file for complete search history.

(56) References Cited

U.S. PATENT DOCUMENTS

| | | | | |
|---|---|---|---|---|
| 9,915,485 | B2 * | 3/2018 | Hudson | F41A 3/86 |
| 2014/0075799 | A1 * | 3/2014 | Hangen | F41A 3/86 42/1.06 |
| 2017/0108304 | A1 * | 4/2017 | Heizer | F41A 3/86 |

* cited by examiner

*Primary Examiner* — J. Woodrow Eldred
(74) *Attorney, Agent, or Firm* — Matthew E. Burr

(57) ABSTRACT

A semi-automatic pistol has a frame having a trigger guard defining a trigger finger space, a barrel connected to the frame and defining a bore axis, a slide connected to the frame and operable to reciprocate along the bore axis between a forward battery position and a rearward open position, a recoil mechanism operably connected between the slide and the frame, and operable to bias the slide to the battery position, and the recoil mechanism being entirely below the barrel axis and forward of the trigger finger space. The recoil mechanism may be a recoil spring defining a spring axis. The spring axis may be parallel to the bore axis. The recoil spring may be a helical shape defining a bore receiving a guide rod. The guide rod may be below the barrel. The trigger guard may have a downwardly facing upper surface defining the trigger finger space.

7 Claims, 31 Drawing Sheets

SEMI-AUTOMATIC PISTOL

CROSS-REFERENCE TO RELATED APPLICATION

This application claims the benefit of U.S. Provisional Patent Application Ser. No. 62/013,090 filed on Jun. 17, 2014, entitled "ANGLED SEAR RELEASE IN A SEMI-AUTOMATIC PISTOL," and U.S. patent application Ser. No. 14/732,644, filed Jun. 5, 2015 and entitled SEMI-AUTOMATIC PISTOL, which are hereby incorporated by reference in their entirety for all that is taught and disclosed therein.

FIELD OF THE INVENTION

The present invention relates to firearms, and more particularly to a pistol that reduces torque about a shooter's wrist, thereby redirecting more of the recoil force straight rearward into a user's major muscle groups and enhancing the functionality of the pistol by reducing muzzle flip to enable more rapid, accurate follow-up shots.

BACKGROUND OF THE INVENTION

A shooter's control of a firearm can be differentiated between pistols and rifles. The way a shooter holds a rifle directs most of the recoil energy into the shoulder and torso. As a result, the rifle is easier to continuously keep on target for subsequent shots because major muscle groups receive the recoil energy, and accurate follow-up shots can be made quickly. Pistols, because they are held at arm's length, require more muscle control by the shooter, and, because of that extended grip, reaction moments from firing the pistol, i.e., recoil, must be counter-acted by the shooter's hand, wrist and arm muscles. Because of the near instantaneous duration of the impulse, nearly all of that reaction moment may be sensed in a rotation of the firearm within the instantaneous "center-of-grip," which may be close to the center of rotation of the pistol. The "center of grip" is also aligned with the effective pivot point of the user's wrist, which may also be thought of as the key point of rotation. The rotation of the pistol resulting from an initial shot delays subsequent shots because the shooter has to expend time adjusting the pistol to reacquire the target prior to firing each follow-up shot. While various attempts have been made to control recoil to reduce firearm movement, recoil is considered the best mechanism for feeding semi-automatic firearms, so recoil elimination is not necessarily desirable.

The Model 1911 is a single-action, semi-automatic, magazine-fed, recoil-operated pistol that served as the standard-issue sidearm for the United States Armed Forces from 1911 to 1985, is still carried by some U.S. forces, and is still popular in the civilian market. The Model 1911, modified for increased accuracy, is popular for use in competitive shooting events. One of the reasons for the popularity of the Model 1911 as a competitive shooting pistol is the draw and break of a 1911 trigger, which has been described as the most crisp, consistent and tunable trigger of all handgun designs. The consistency of the draw and the break of a Model 1911 trigger provides a "feel" that some shooters prefer because it minimizes one variable in the shooting action. However, the Model 1911 suffers from the disadvantage of all prior art pistols in that the placement of the recoil mechanism at such a distance above the shooter's wrist contributes to greater torque about the shooter's wrist, making it difficult for the user to continuously keep the Model 1911 on target for follow-up shots.

U.S. Pat. No. 5,415,075 to Moon discloses a firearm having a moveable breech locking barrel supported on a receiver by an offset barrel cam lug. Moon discloses a recoil spring that is entirely below the barrel bore, but not the barrel, given that the protruding cam surfaces on the barrel located below the bore that the recoil spring rests against are integral to the barrel. Furthermore, Moon's recoil spring is above the trigger guard area. Moon's design forces the barrel up higher with respect to the shooter's hand, to make room between the trigger finger and the barrel for the captured recoil spring assembly. The placement of the recoil mechanism at such a distance above the shooter's wrist contributes to greater torque about the shooter's wrist, making it difficult for the user to continuously keep Moon's firearm on target for follow-up shots.

Therefore, a need exists for a new and improved semi-automatic pistol that reduces torque about a shooter's wrist by lowering the plane on which the recoil force is acting, thereby redirecting some of the recoil force straight rearward into a user's major muscle groups to prevent undesirable movement of the pistol between shots. In this regard, the various embodiments of the present invention substantially fulfills some of these needs. In this respect, the semi-automatic pistol according to the present invention substantially departs from the conventional concepts and designs of the prior art, and in doing so provides an apparatus primarily developed for the purpose of providing a semi-automatic pistol that reduces torque about a shooter's wrist by lowering the plane on which the recoil force is acting, thereby redirecting some of the recoil force straight rearward into a user's major muscle groups to prevent undesirable movement of the pistol between shots.

SUMMARY OF THE INVENTION

The present invention provides an improved semi-automatic pistol, and overcomes the above-mentioned disadvantages and drawbacks of the prior art. As such, the general purpose of the present invention, which will be described subsequently in greater detail, is to provide an improved semi-automatic pistol that has all the advantages of the prior art mentioned above.

To attain this, the preferred embodiment of the present invention essentially comprises a frame having a trigger guard defining a trigger finger space, a barrel connected to the frame and defining a bore axis, a slide connected to the frame and operable to reciprocate along the bore axis between a forward battery position and a rearward open position, a recoil mechanism operably connected between the slide and the frame, and operable to bias the slide to the battery position, and the recoil mechanism being entirely below the barrel axis and forward of the trigger finger space. The recoil mechanism may be a recoil spring defining a spring axis. The spring axis may be parallel to the bore axis. The recoil spring may be a helical shape defining a bore receiving a guide rod. The guide rod may be below the barrel. The trigger guard may have a downwardly facing upper surface defining the trigger finger space. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

1 illustrating the slide assembly full retracted and the chamber open with a cartridge positioned for re-loading.

Figure 1:
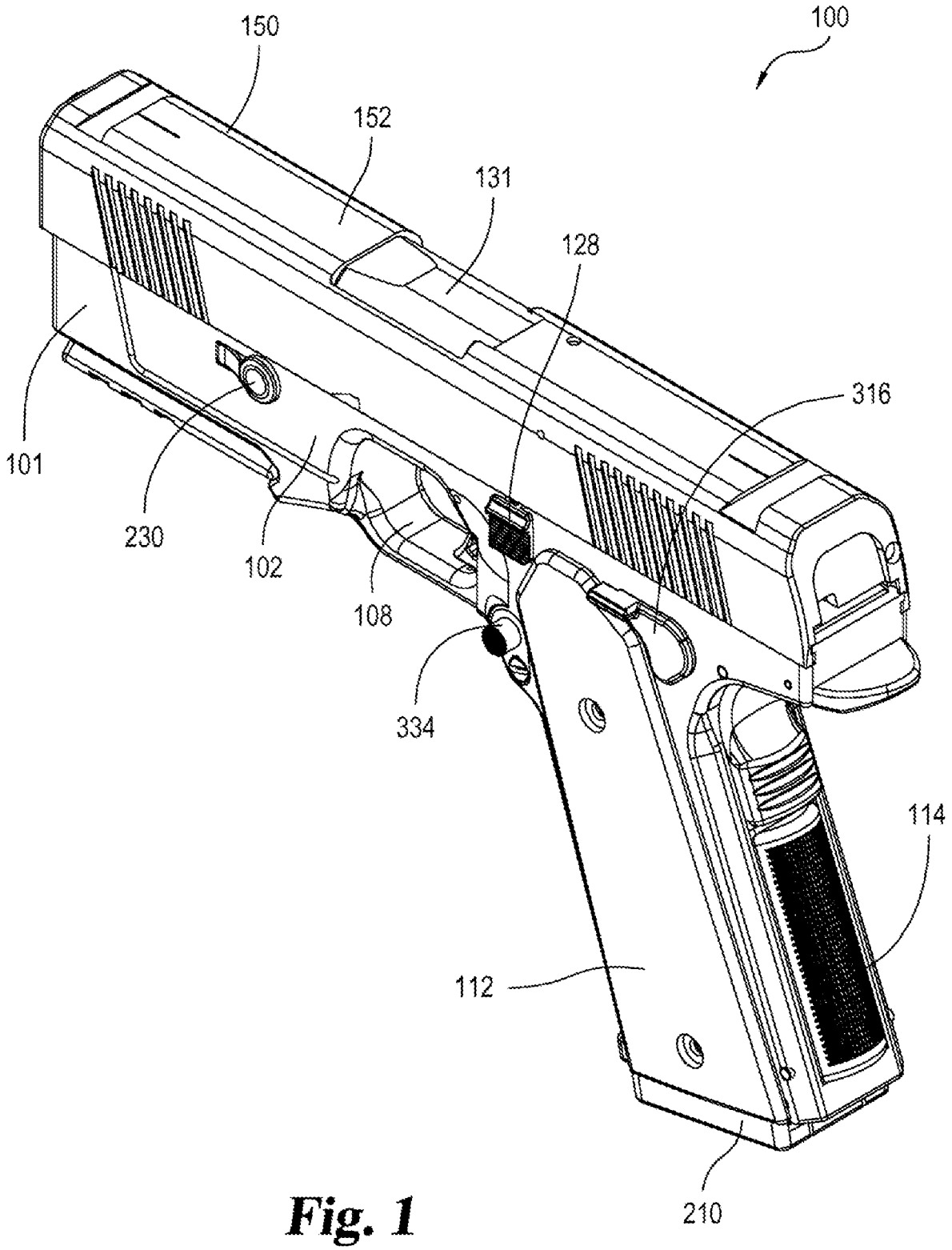
FIG. 1 is a perspective view of the current embodiment of a semi-automatic pistol constructed in accordance with the principles of the present invention.
Figure 2:
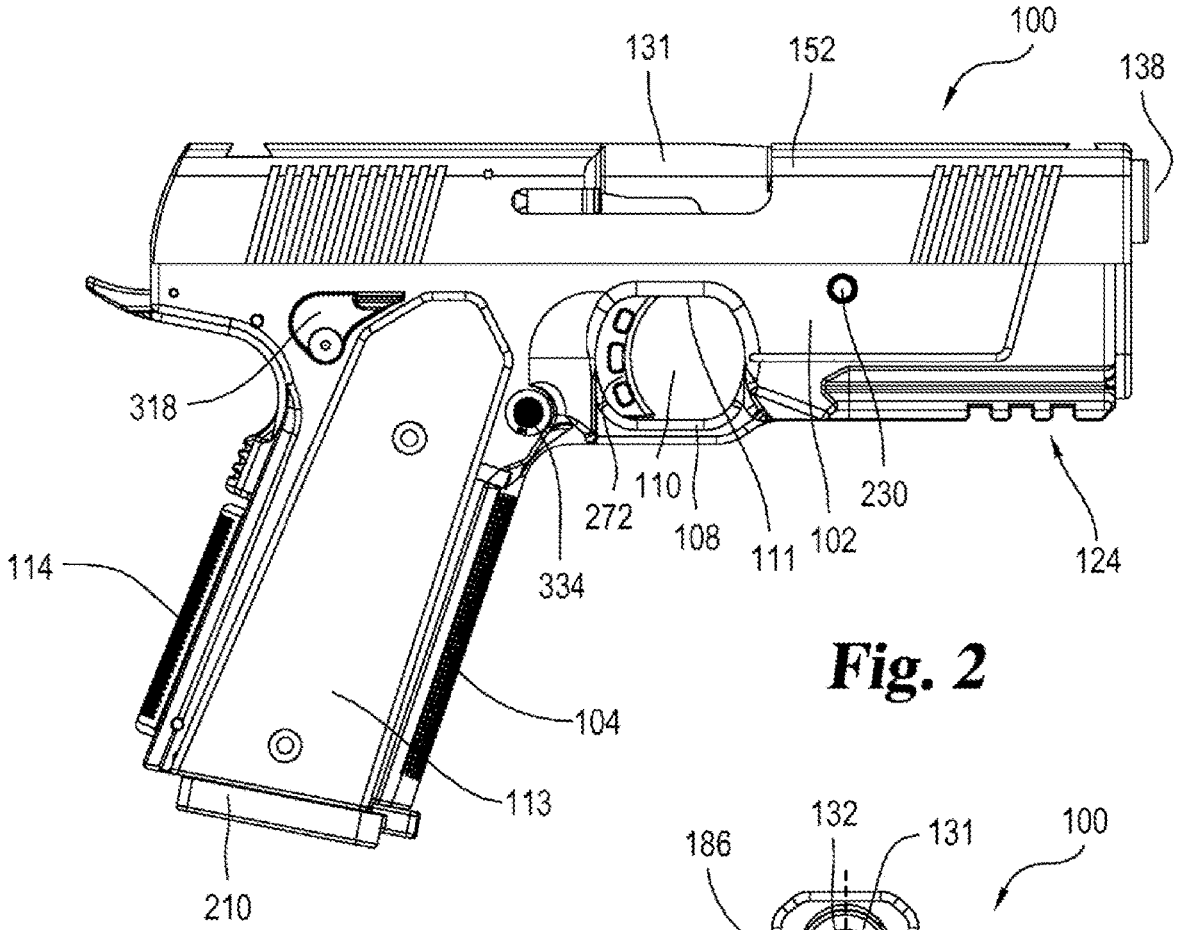
FIG. 2 is a right-side elevational view of the current embodiment of the semi-automatic pistol of FIG. 1.
Figure 3:
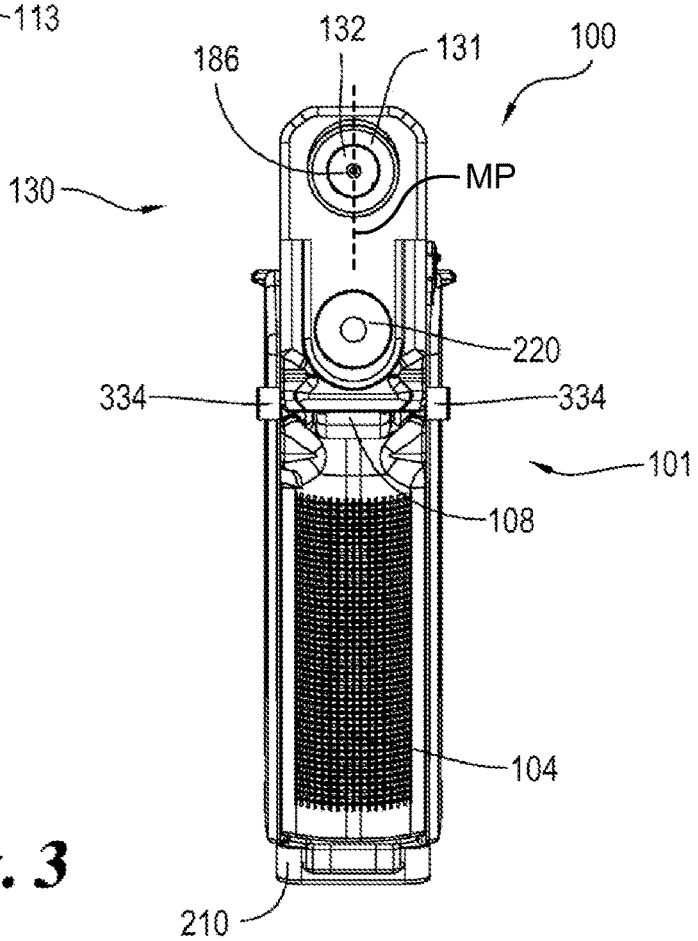
FIG. 3 is a front elevational view of the right side of the current embodiment of the semi-automatic pistol of FIG. 1.
Figure 4:
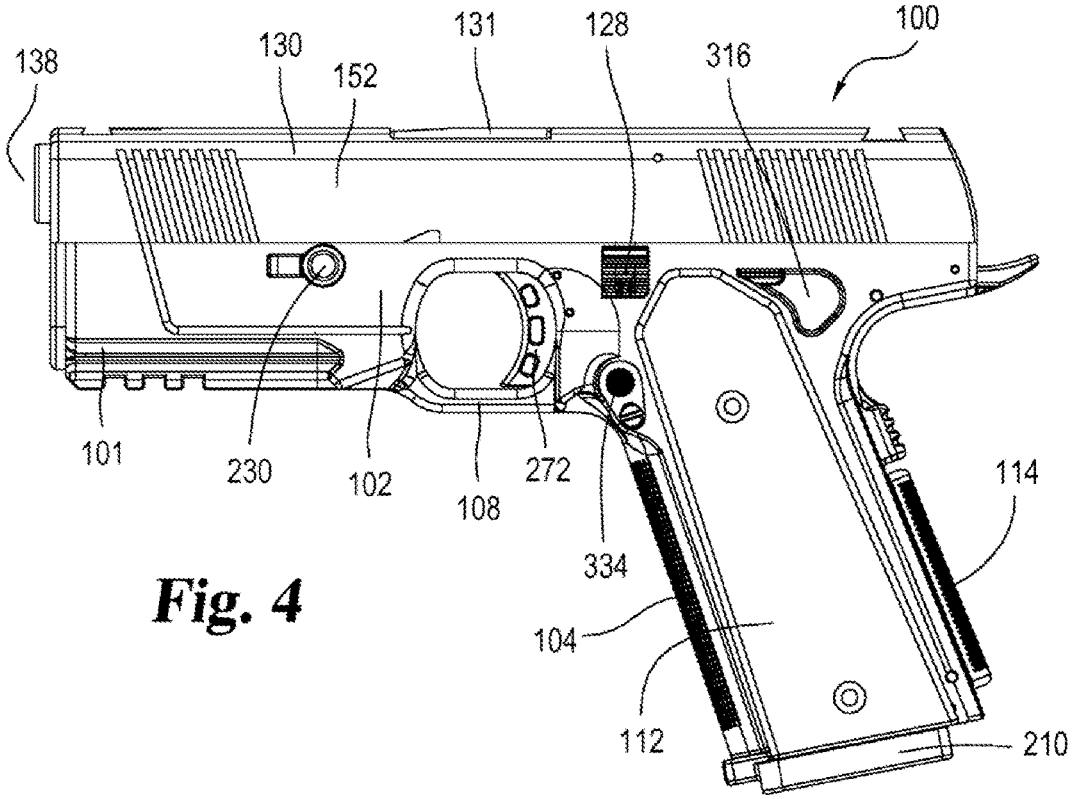
FIG. 4 is a left-side elevational view of the left side of the current embodiment of the semi-automatic pistol of FIG. 1.
Figure 5:
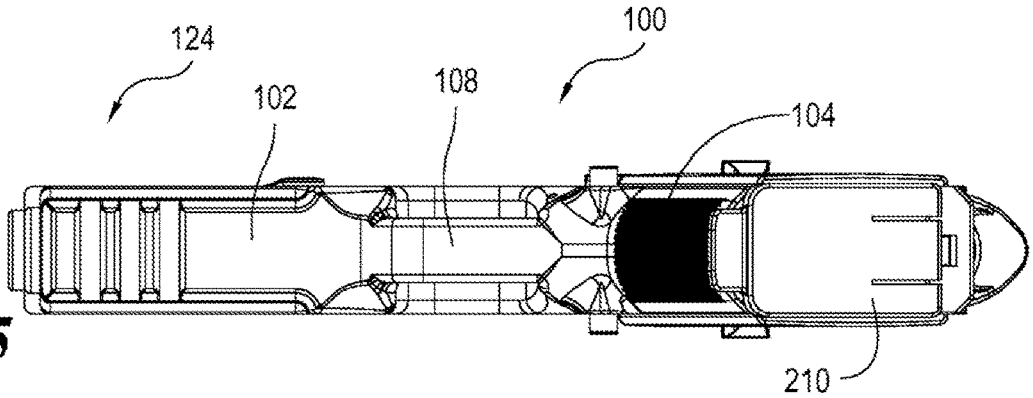
FIG. 5 is a bottom plan view of the current embodiment of the semi-automatic pistol of FIG. 1.
Figure 6:
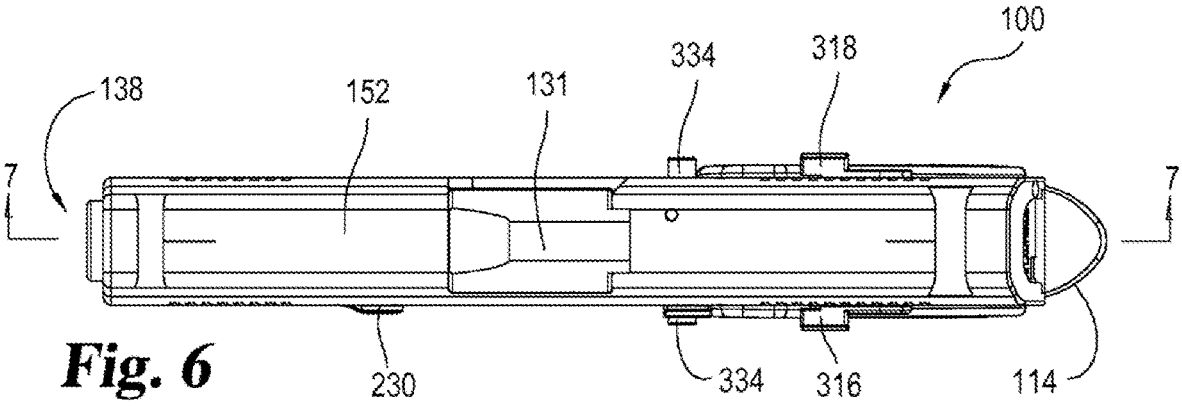
FIG. 6 is a top plan view of the current embodiment of the semi-automatic pistol of FIG. 1.
Figure 49:
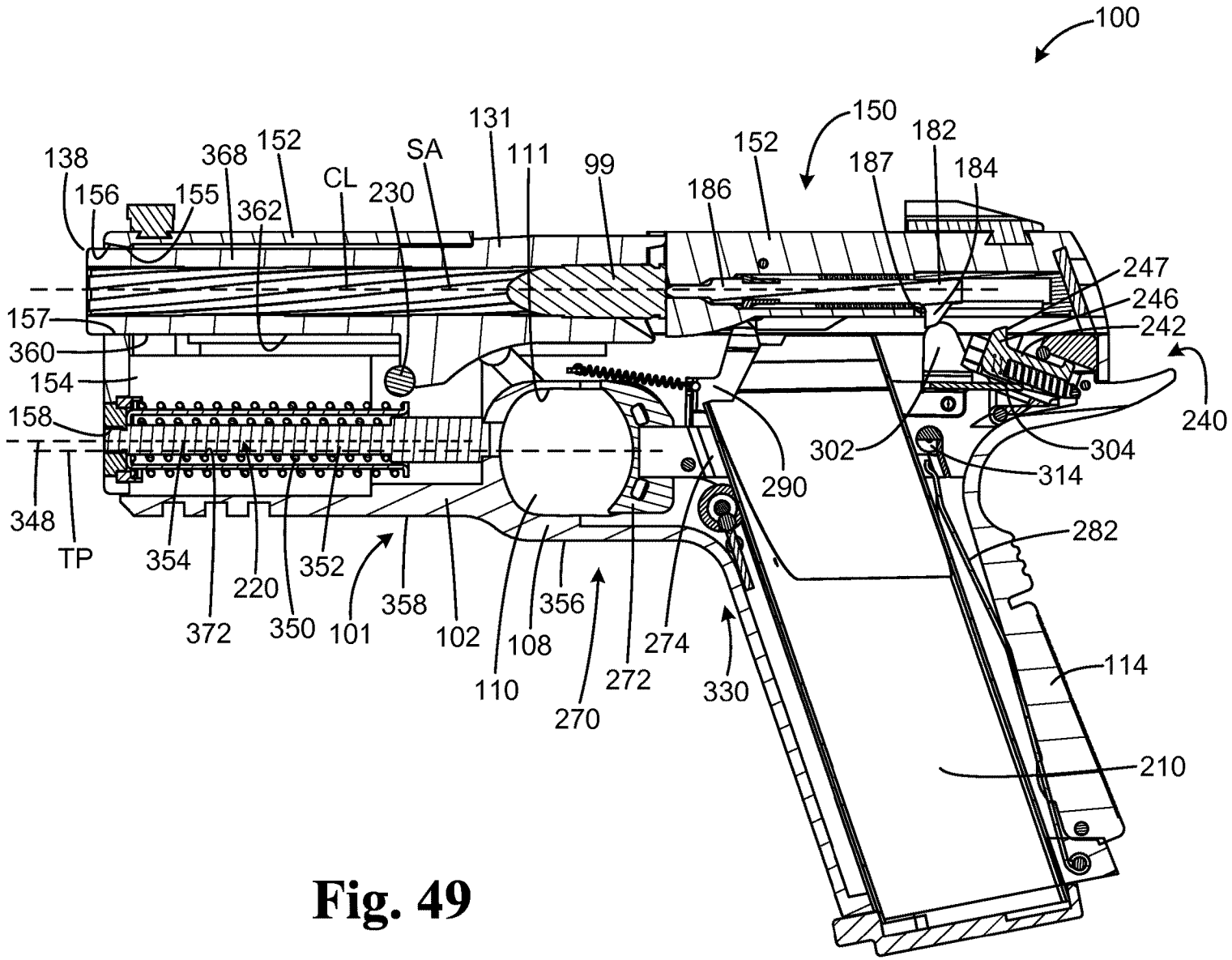

FIG. 49 is a left-side elevational cross-sectional view of the current embodiment of the semi-automatic pistol of FIG. 1 illustrating a cartridge being stripped by the slide and entering the chamber in the barrel.

Figure 50:
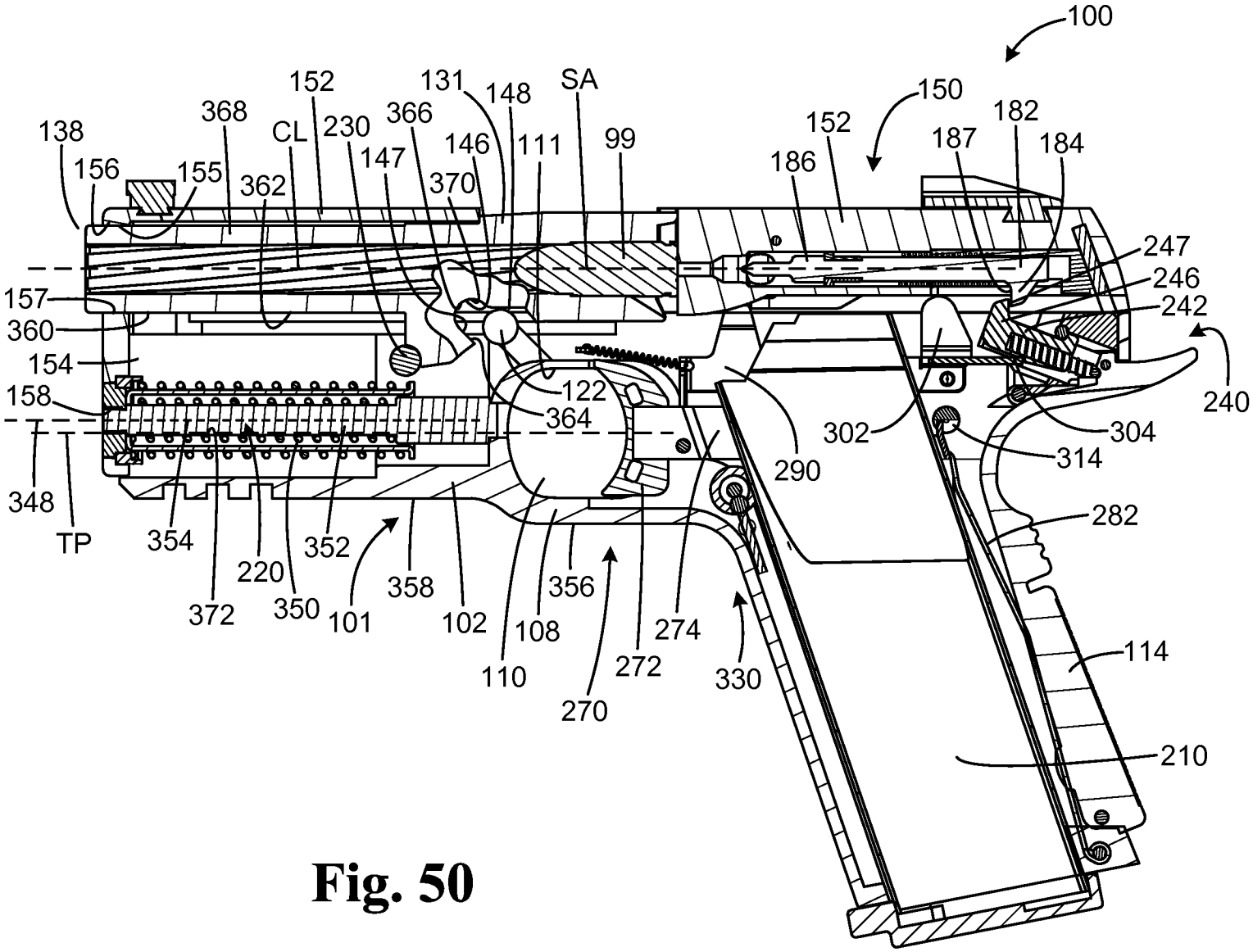

FIG. 50 is a left-side elevational cross-sectional view of the current embodiment of the semi-automatic pistol of FIG. 1 illustrating a cartridge in battery in the barrel with the action assembly in a neutral position.

Figure 51:
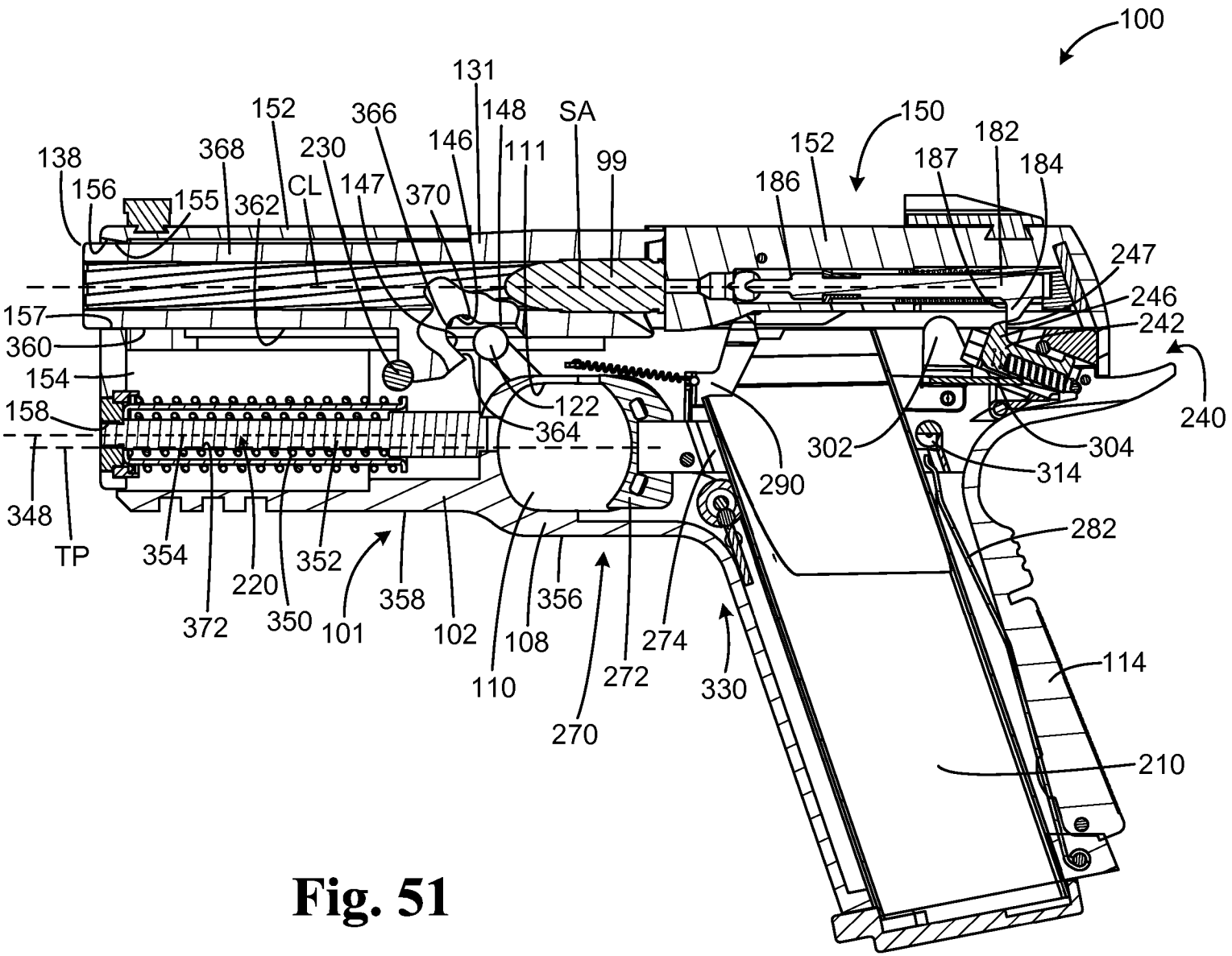

FIG. 51 is a left-side elevational cross-sectional view of the current embodiment of the semi-automatic pistol of FIG. 1 illustrating the pistol as the trigger is pulled and the striker is released.

Figure 52:
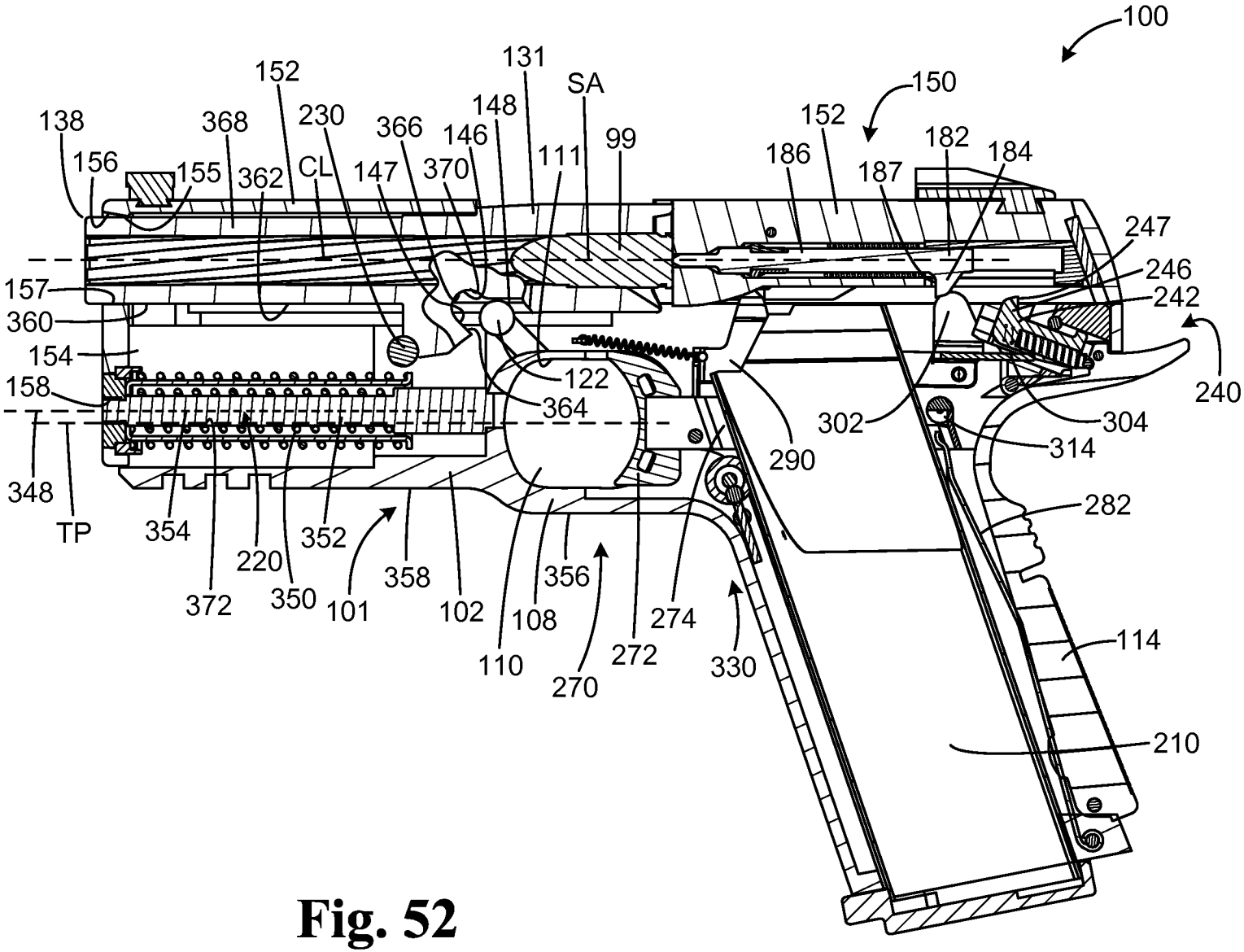

FIG. 52 is a left-side elevational cross-sectional view of the current embodiment of the semi-automatic pistol of FIG. 1 illustrating the firing pin impacting a cartridge located in the chamber in the barrel.

Figure 53:
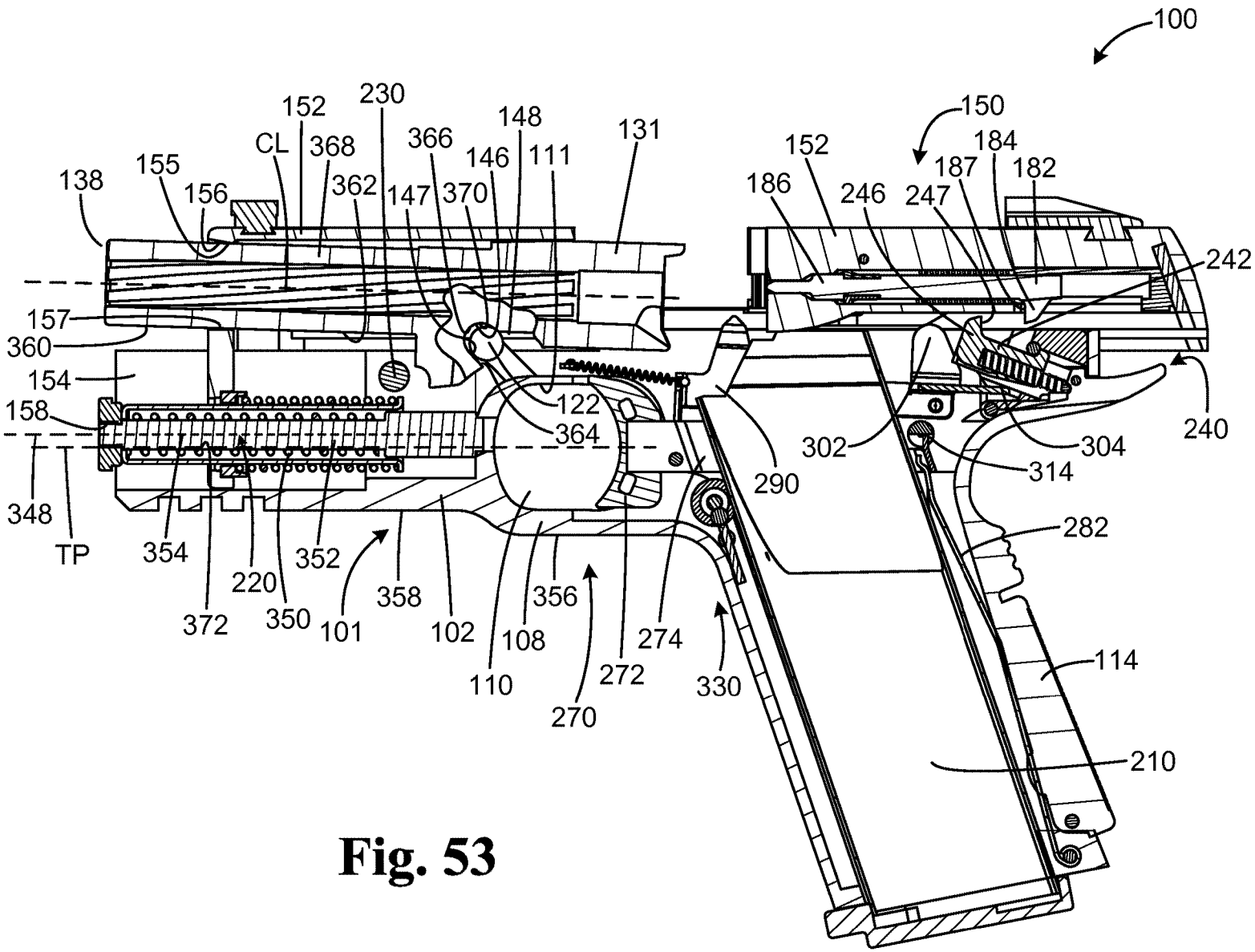

FIG. 53 is a left-side elevational cross-sectional view of the current embodiment of the semi-automatic pistol of FIG. 1 illustrating partial blow back of the slide assembly after a cartridge has been fired and extraction of a brass case from the chamber in the barrel.

Figure 54:
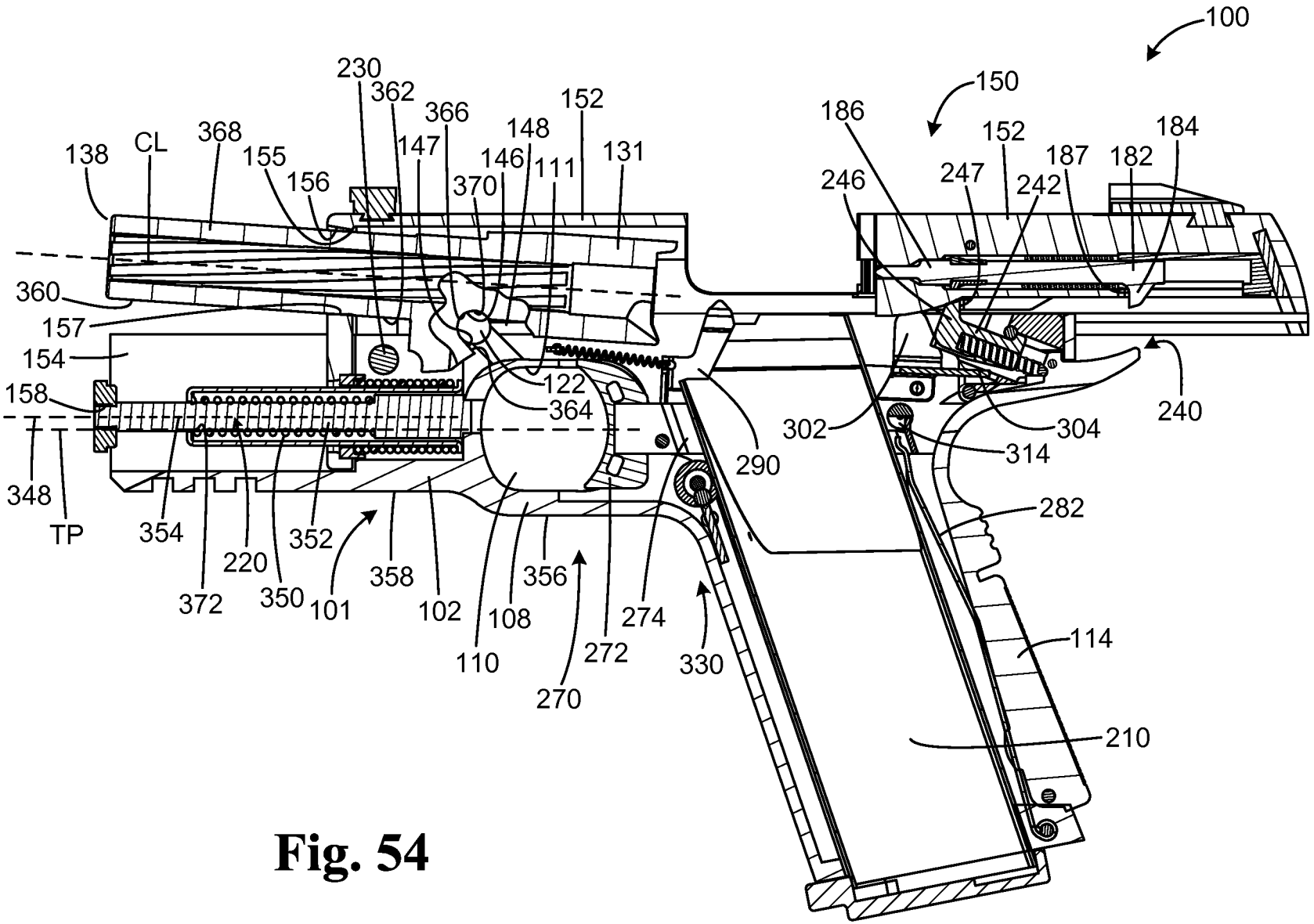

FIG. 54 is a left-side elevational cross-sectional view of the current embodiment of the semi-automatic pistol of FIG. 1 illustrating the slide assembly fully retracted and the chamber open with a cartridge positioned for re-loading.

Figure 55:
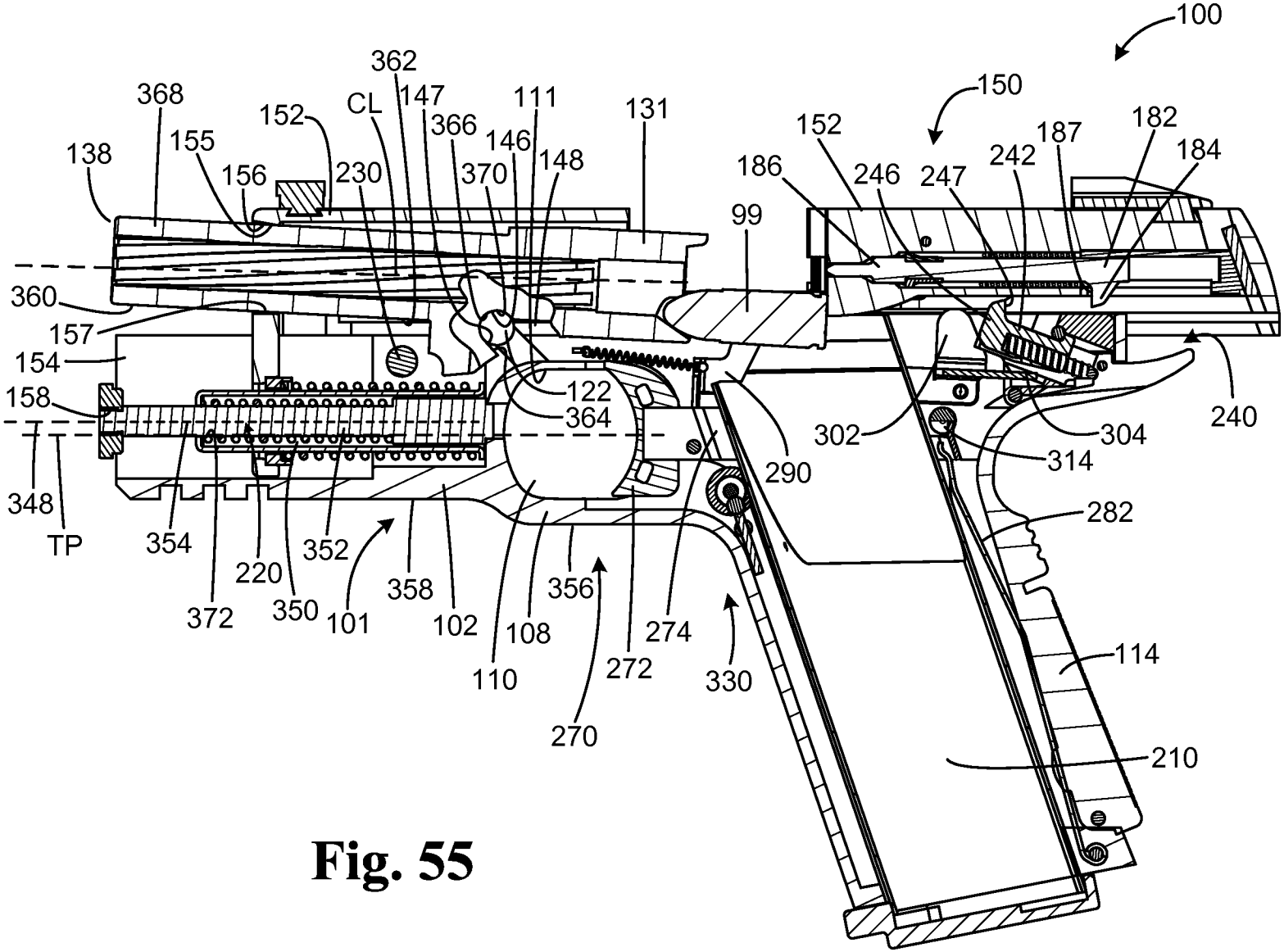

FIG. 55 is a left-side elevational cross-sectional view of the current embodiment of the semi-automatic pistol of FIG. 1 illustrating a cartridge being stripped by the slide and entering the chamber in the barrel.

The same reference numerals refer to the same parts throughout the various figures.

DESCRIPTION OF THE CURRENT EMBODIMENT

An embodiment of the semi-automatic pistol of the present invention is shown and generally designated by the reference numeral 100.

FIGS. 1-7 illustrate the improved semi-automatic pistol 100 of the present invention. More particularly, pistol 100 generally includes receiver 101 and slide barrel assembly 130. Slide barrel assembly 130 generally includes barrel 131 and slide assembly 150.

Figure 8:
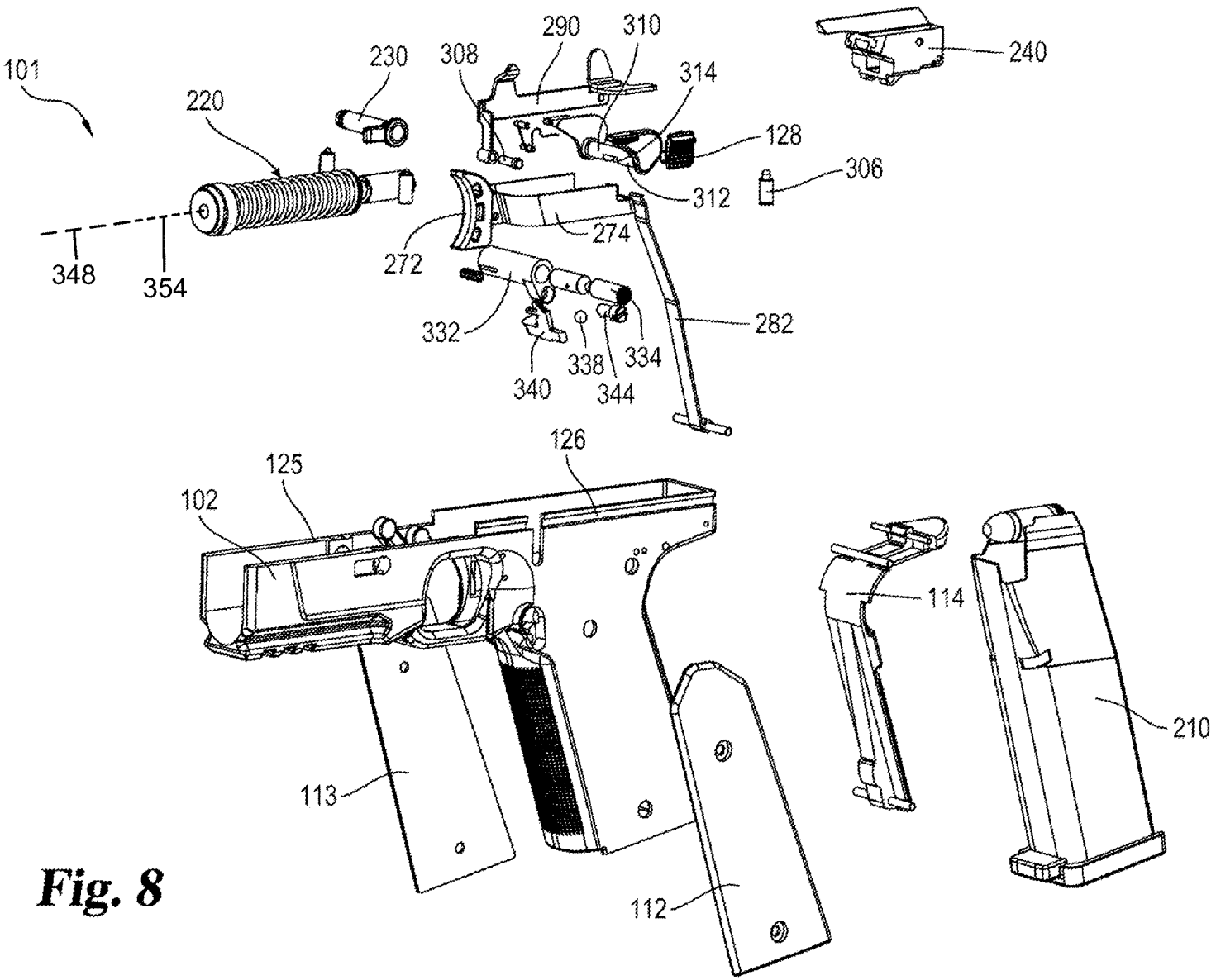
FIG. 8 is an exploded perspective assembly view of a receiver of the current embodiment of the semi-automatic pistol of FIG. 1.
Figure 9:
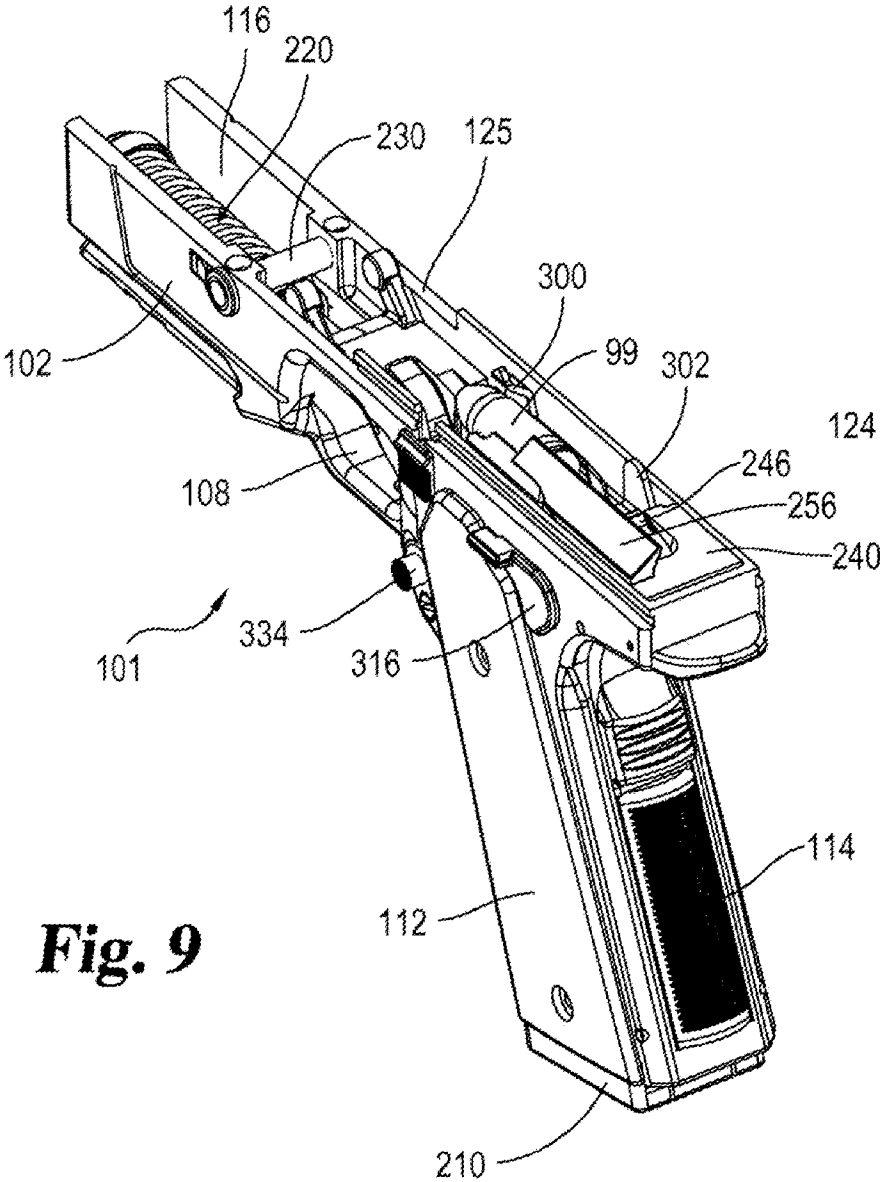
FIG. 9 is a perspective view of the receiver of FIG. 8.

FIGS. 8 and 9 illustrate the improved receiver 101 of the present invention. More particularly, receiver 101 includes frame 102, magazine 210, recoil spring assembly 220, takedown pin 230, sear assembly 240, trigger bow assembly 270, trigger bar 290, trigger safety 310 and magazine release assembly 330.

Figure 10:
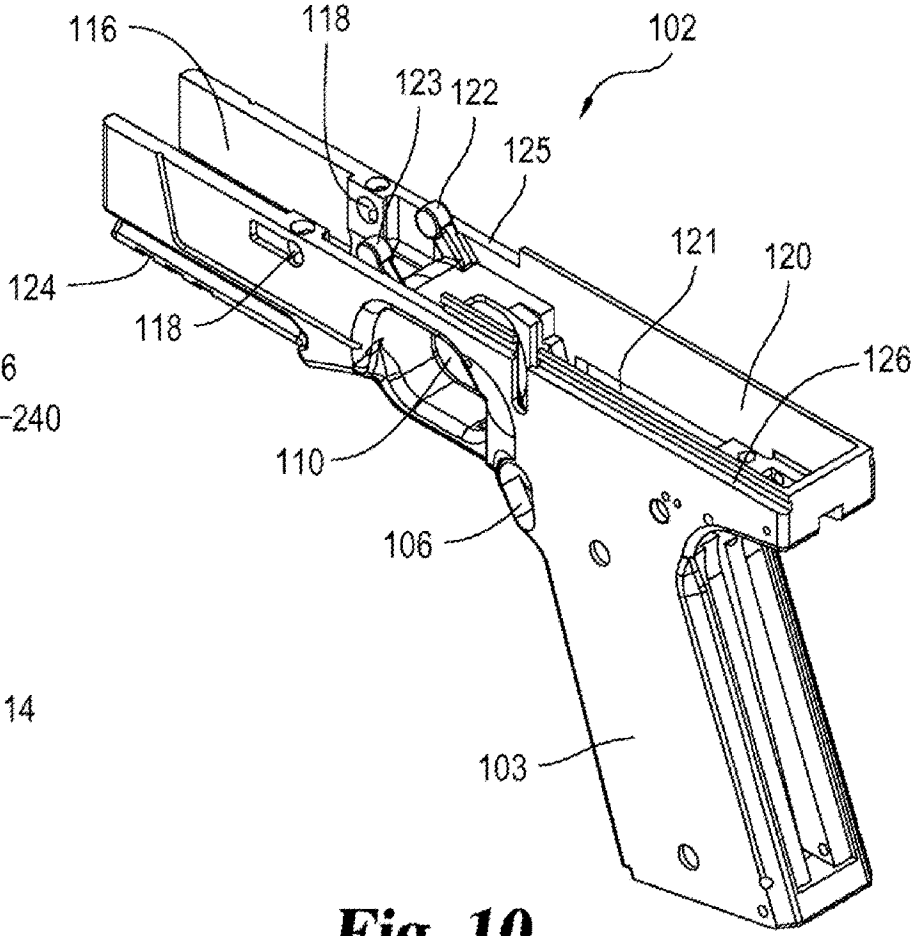
FIG. 10 is a perspective view of a frame of the current embodiment of the semi-automatic pistol of FIG. 1.
Figure 11:
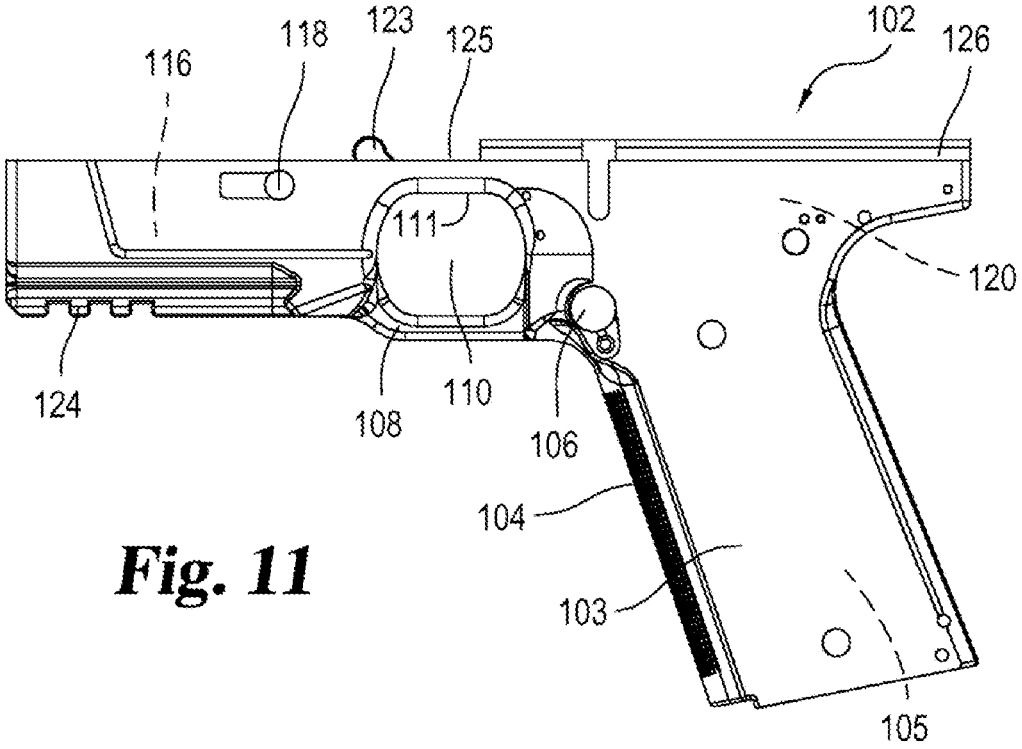
FIG. 11 is a left-side elevational view of the frame of FIG. 10.
Figure 12:
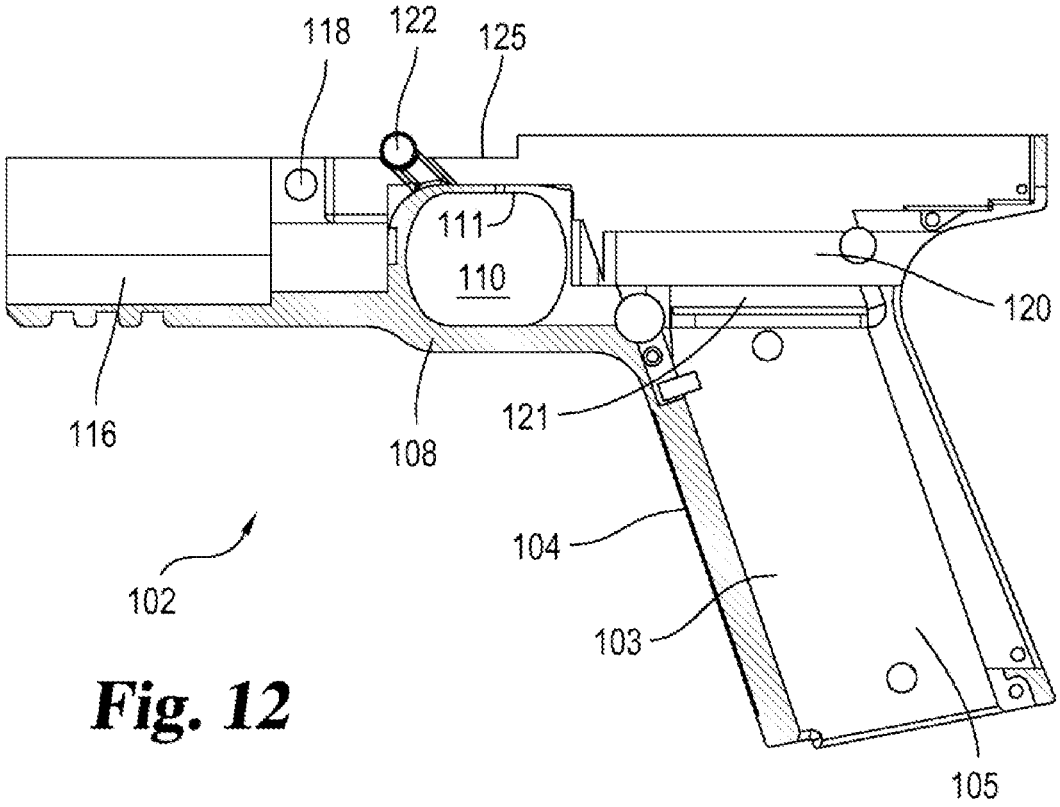
FIG. 12 is a left-side elevational cross-sectional view of the frame of FIG. 10.

FIGS. 10-12 illustrate the improved frame 102 of the present invention. More particularly, frame 102 includes handle portion 103, forward grip 104, magazine well 105, magazine release recess 106, trigger guard 108, finger opening/trigger recess 110 defined by trigger guard 108, grip 112, grip 113, back grip 114, recoil spring well 116, take down pin recess 118, action well 120, grooves 121, cam pin/trunnion 122, cam pin/trunnion 123, rail 124, top edge 125, grooves 126 and slide latch 128. Cam pins/trunnions 122 and 123 are attached to frame 102 proximate barrel 131. Cam pins/trunnions 122 and 123 can be positioned as a pair, each spaced apart from each other to receive a portion of the barrel 131 therebetween.

Figure 19:
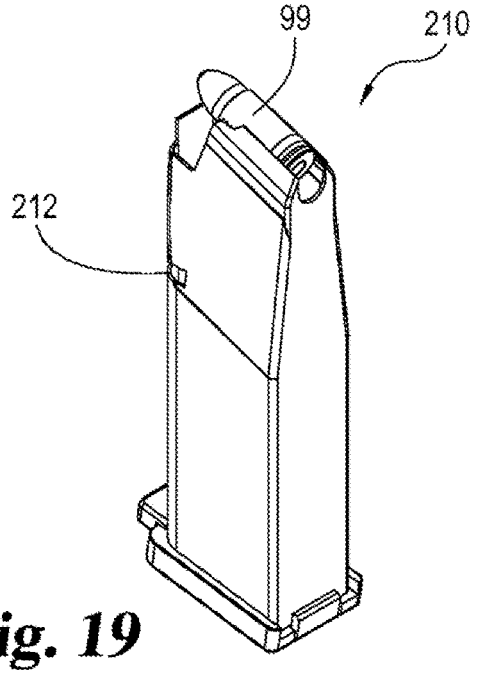
FIG. 19 is a perspective view of a magazine of the current embodiment of the receiver of FIG. 8.

FIG. 19 illustrates the improved magazine 210 of the present invention. More particularly, magazine 210 includes catch 212 and holds a plurality of cartridges 99. As described below, magazine fits within magazine well 105 in frame 102.

Figure 17:
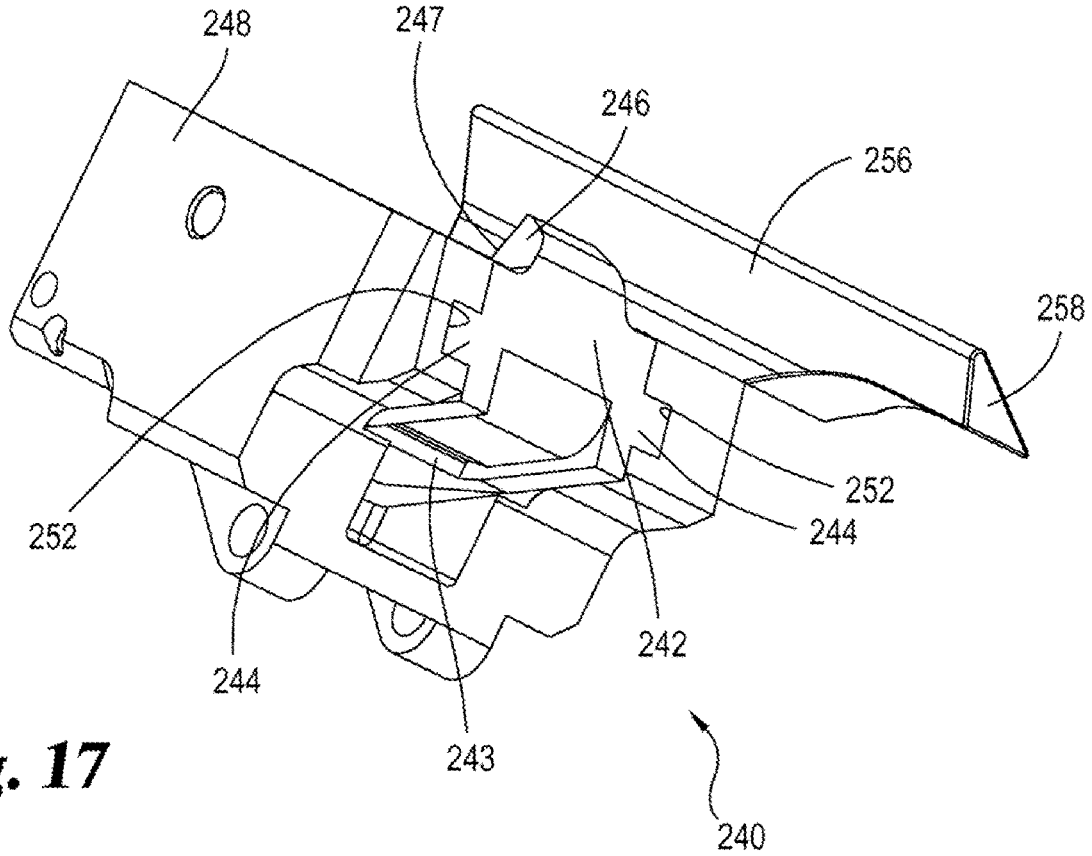
FIG. 17 is a perspective view of a sear assembly of the current embodiment of the receiver of FIG. 8.
Figure 18:
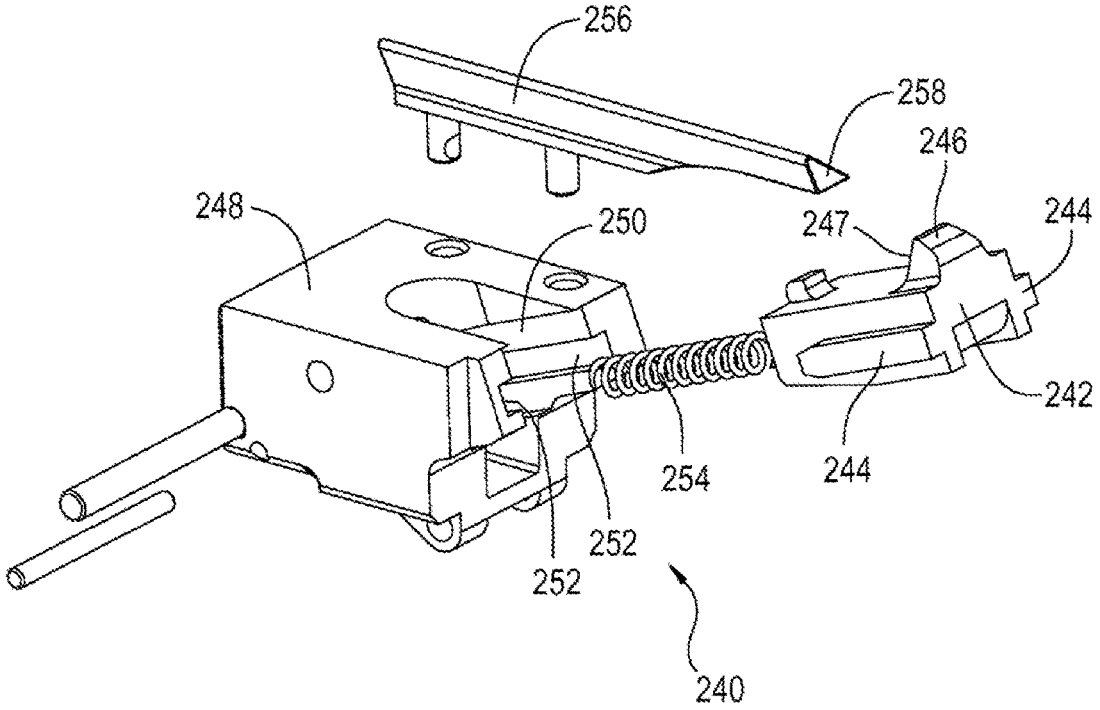
FIG. 18 is an exploded perspective view of the sear assembly of FIG. 17.

FIGS. 17-18 illustrate the improved sear assembly 240 of the present invention. More particularly, sear assembly 240 generally includes sear 242, projections 244, sear catch 246, sear block 248, recess 250, grooves 252, spring 254, ejector 256 and ejector tip 258. Sear assembly 240 can be removably fixed in position relative to frame 102 with pins (illustrated but not numbered).

Figure 13:
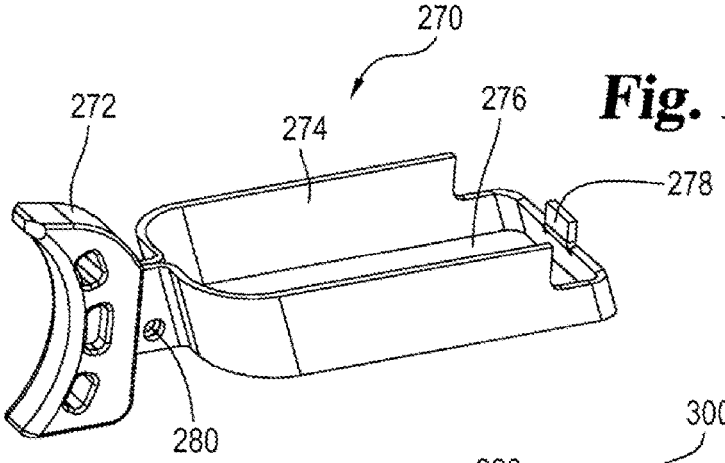
FIG. 13 is a perspective view of a trigger bow assembly of the current embodiment of the receiver of FIG. 8.

FIG. 13 illustrates the trigger bow assembly 270 of the present invention. More particularly, trigger bow assembly 270 includes trigger 272 defining horizontal trigger plane TP (shown in FIG. 7) that is vertically centered in the trigger guard 108, bow 274, opening 276, safety catch 278, hole 280 and spring 282. Trigger bow assembly is movably mounted on frame 102 and fits within grooves 121. Trigger plane TP bisects trigger 272 and is parallel to bore axis/center line CL of bore 132. Frame 102 has a forward lower surface 358 located forward of the trigger guard 108 and positioned at a level below the trigger plane TP. In the current embodiment, forward lower surface 358 is positioned at a level above a bottom portion 356 of the trigger guard 108 by less than 0.181 inch in an application with a picatinny rail, and less than 0.25 in an application without a rail, and in other applications based on spring dimensions.

Figure 14:
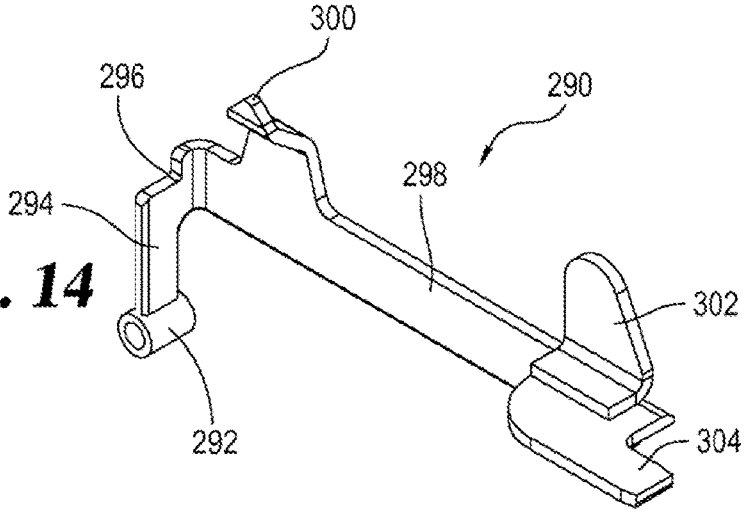
FIG. 14 is a perspective view of a trigger bar of the current embodiment of the receiver of FIG. 8.
Figure 15:
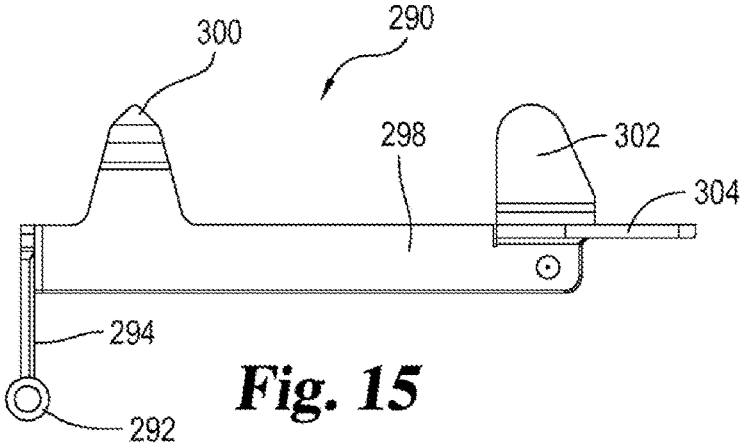
FIG. 15 is a left-side elevational view of the trigger bar of FIG. 14.
Figure 16:
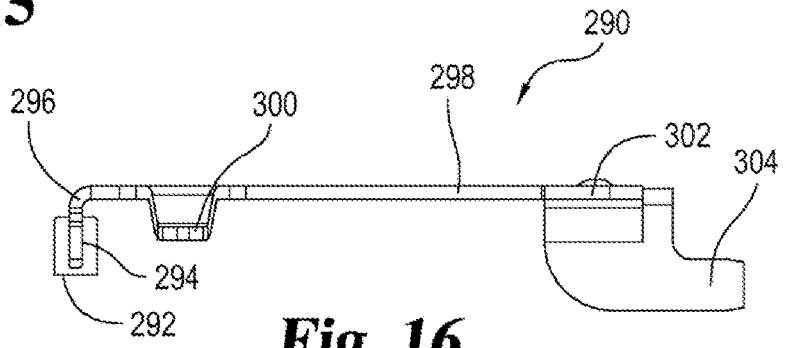
FIG. 16 is a top plan view of the trigger bar of FIG. 14.

FIGS. 14-16 illustrate the improved trigger bar 290 of the present invention. More particularly, trigger bar 290 includes pivot point 292, extension 294, lateral offset 296, body 298, safety cam 300, sear reset cam 302, tongue 304, plunger 306 and pin 308. Trigger bar 290 is rotationally coupled to trigger bow assembly 270 by pin 308, which passes through hole 280 and pivot point 292.

As shown in FIG. 8, trigger safety 310 includes bar 312, recess 314, lever 316 and lever 318. Trigger safety 310 is configured to selectively block movement of trigger bow assembly 270 to prevent trigger bow assembly 270 (and trigger 272) from moving through their full range of motion. In the illustrated configuration, trigger safety 310 blocks substantially any movement of trigger bow assembly 270.

Figure 20:
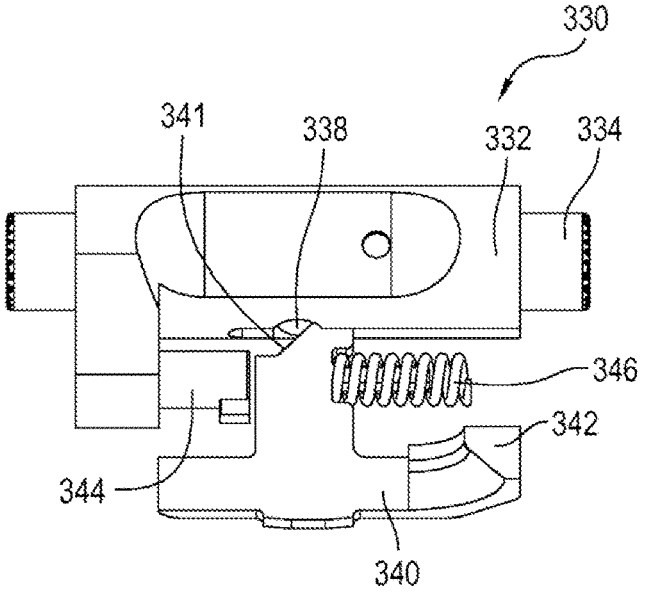
FIG. 20 is a back elevational view of a magazine release assembly of the current embodiment of the receiver of FIG. 8.
Figure 21:
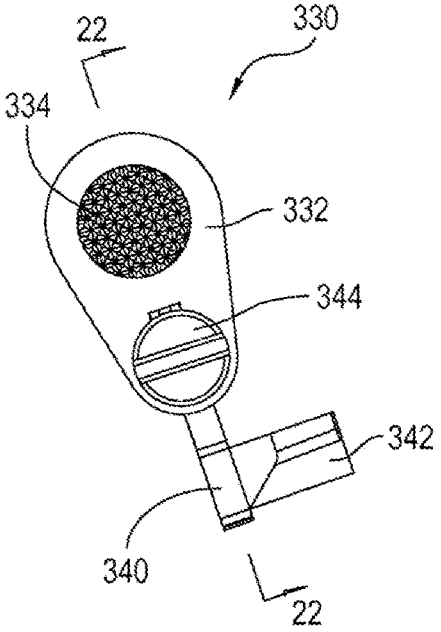
FIG. 21 is a left-side elevational view of the magazine release assembly of FIG. 20.
Figure 22:
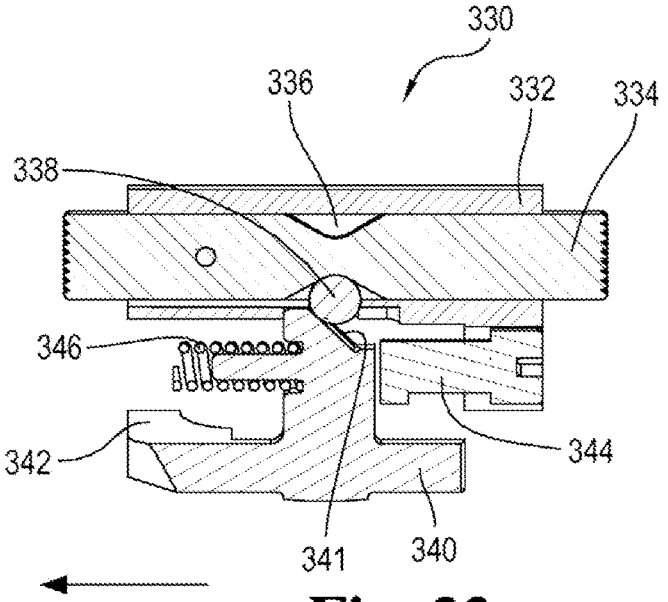
FIG. 22 is a front elevational cross-sectional view of the current embodiment of the magazine release assembly of FIG. 20 taken along line 22-22 of FIG. 21.

FIGS. 20-22 illustrate the improved magazine release assembly 330 of the present invention. More particularly, magazine release assembly 330 includes body 332, button 334, tapered recess 336, detent ball 338, linkage 340, projection 342, cam 344 and spring 346. Magazine release assembly 330 is configured such that projection 342 may selectively interface with catch 212 to permit retention and selective removal of magazine 210 from receiver 101.

Figure 29:
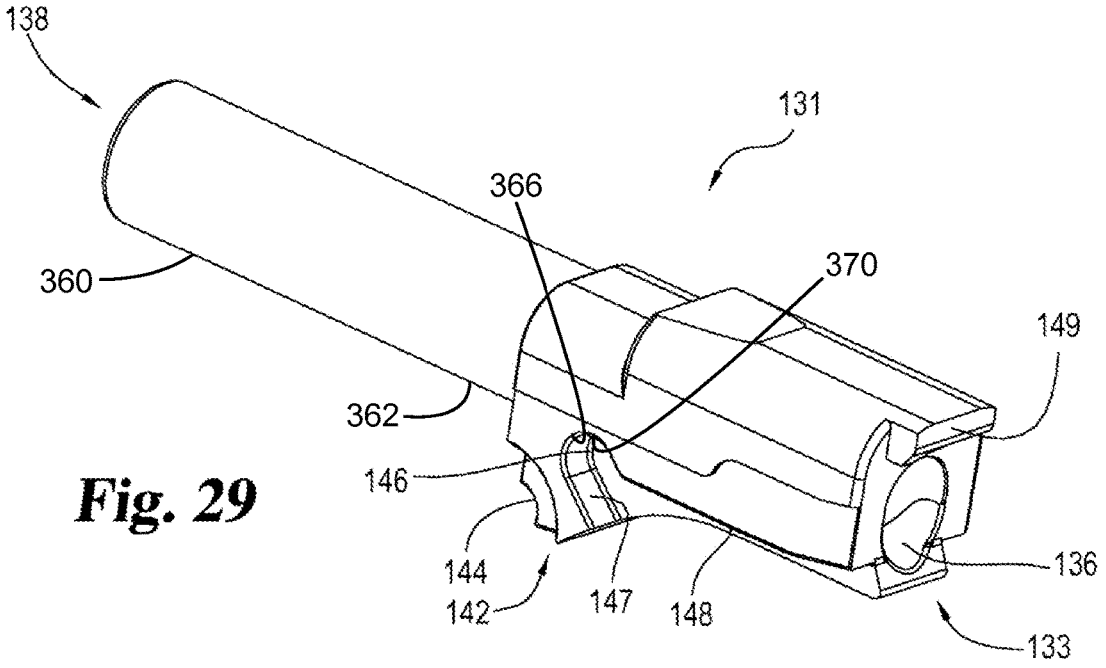
FIG. 29 is a back elevational view of a barrel of the current embodiment of the slide barrel assembly of FIG. 23.
Figure 30:
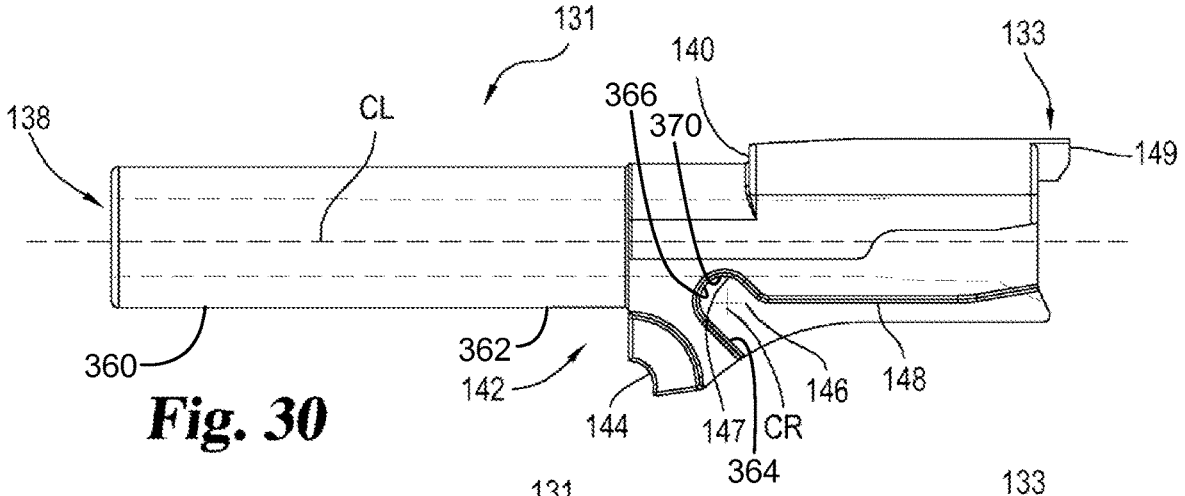
FIG. 30 is a left-side elevational view of the barrel of FIG. 29.
Figure 31:
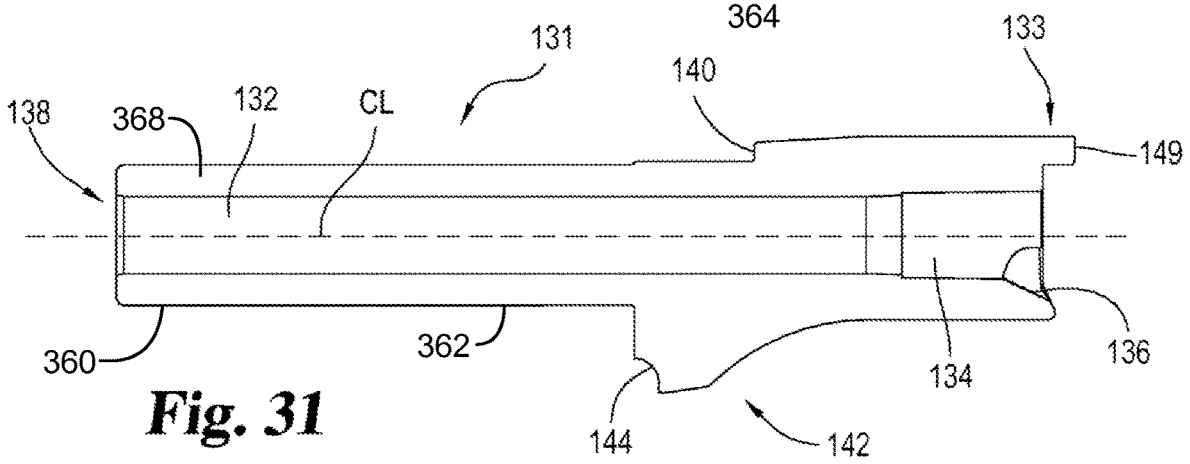
FIG. 31 is a left-side elevational cross-sectional view of the barrel of FIG. 29.

FIGS. 29-31 illustrate the improved barrel 131 of the present invention. More particularly, barrel 131 has a forward tubular portion 360 having a lower wall surface portion 362. Barrel 131 defines bore 132 having a bore axis/center line CL with bore 132 including breech 133 defining a chamber 134 configured to accept a cartridge 99. Chamber 134 also defines ramp 136 which is configured and arranged to guide cartridges 99 during the reload phase of pistol 100. Barrel 131 also defines muzzle 138, shoulder 140, protuberance 142, shoulder 144, recesses 146, cam channel/path 147, clearance 148 and shoulder 149. Cam path 147 in recess 146 receives cam pins/trunnions 122 and 123 and defines center of rotation CR about which barrel 131 rotates about trunnions 122 and 123. Recesses 146 with cam channels/paths 147 are defined in a pair of opposed lateral side portions of the rear/breech portion 133 of the barrel 131, and have a vertical floor surface 370 spaced apart from a medial plane MP of the barrel 131, such that the barrel wall 368 thickness is maintained above a preselected dimension proximate to the cam channels/paths 147. Recesses 146 are used instead of conventional through holes because the center of rotation CR would otherwise penetrate the bore 132. The recesses 146 are positioned to locate the center of rotation CR forward of the trigger 272 to reduce the distance between the bore axis/center line CL of the bore 132 relative to a center of mass of the pistol 100, center of resistance provided by the grip, the effective wrist pivot point, or the highest point of the user's grip. As a result, recoil force resulting from the discharge of the pistol 100 is directed straight rearward into a user's major muscle groups rather than upward and rearward above a user's wrist. Directing the recoil force straight rearward reduces rotation of the pistol 100, thereby greatly decreasing the need to adjust the pistol 100 to reacquire the target prior to firing each follow-up shot. Cam path 147 in recess 146 has a guide surface 364 that is angled downwardly to the rear with respect to the bore axis/center line CL, such that rearward movement of the barrel 131 in recoil drives the rear portion/breech end 133 of the barrel 131 in a downward direction as the cam channel/path guide surface 364 slides over the cam pins/trunnions 122 and 123. The cam path 147 in recess 146 has an upper portion 366 above the level of the lower wall surface portion of the forward tubular portion 360 of the barrel 131.

FIGS. 23-26 illustrate the improved slide assembly 150 of the present invention. More particularly, slide assembly 150 generally includes slide 152, striker assembly 180, extractor assembly 190 and striker safety 320.

Figure 7:
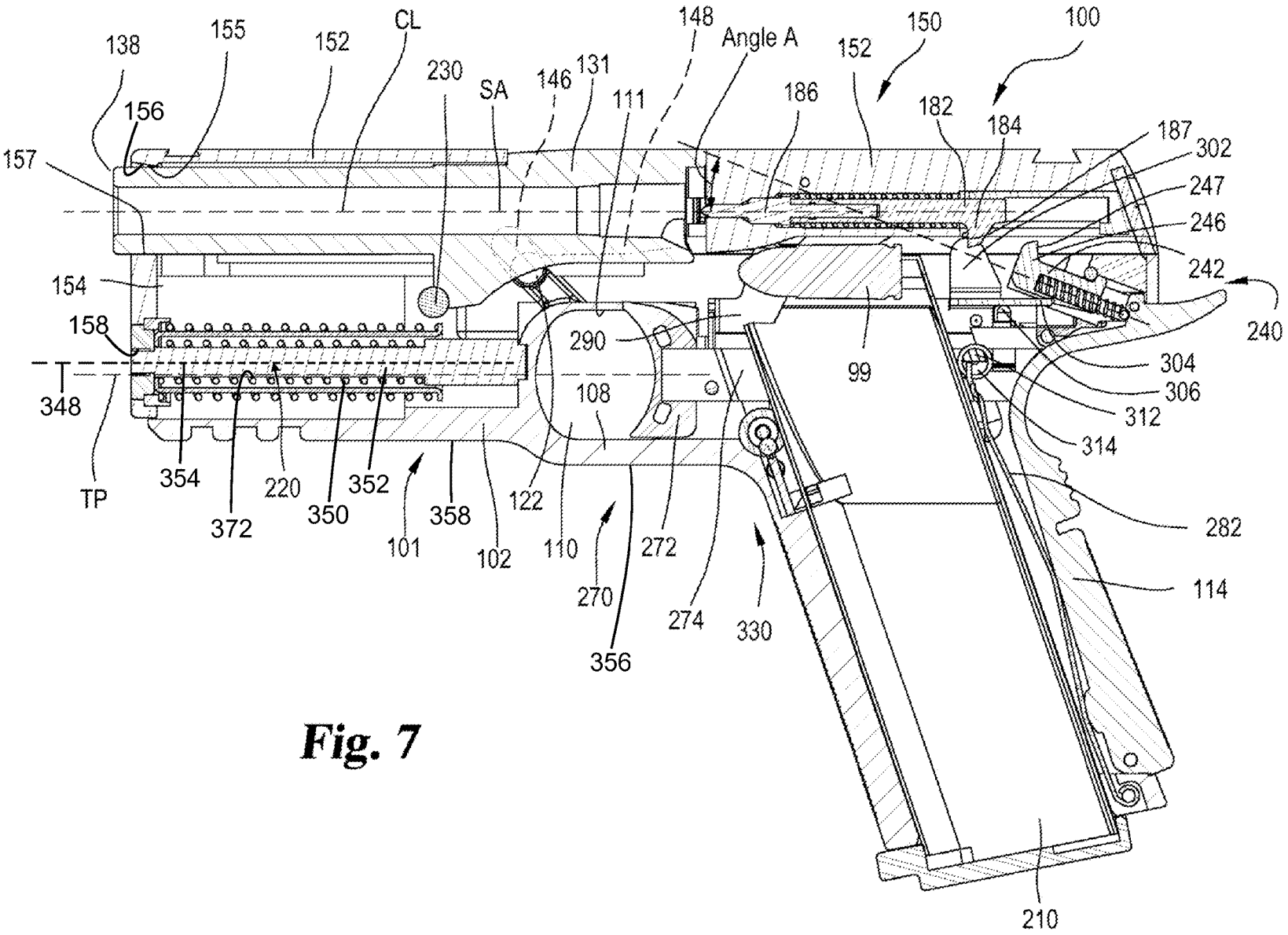
FIG. 7 is a left-side elevational cross-sectional view of the current embodiment of the semi-automatic pistol of FIG. 1 taken along line 7-7 of FIG. 6.
Figure 28:
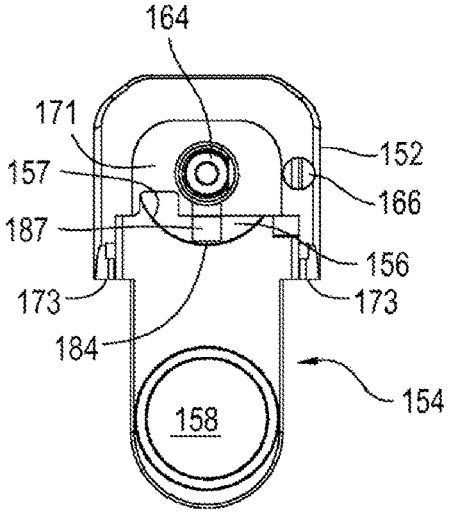
FIG. 28 is a back elevational view of the slide of FIG. 27.
Figure 27:
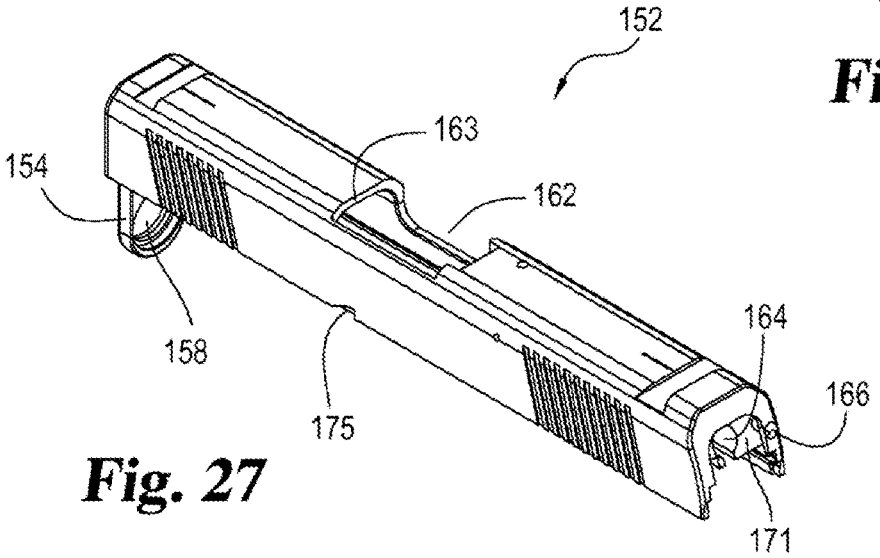
FIG. 27 is a top perspective view of a slide of the current embodiment of the slide assembly of FIG. 25.

FIGS. 27 and 28 illustrate the improved slide 152 of the present invention. More particularly, slide 152 generally includes projection 154, surface 155, aperture 156, surface 157, aperture 158, barrel well 160, face 161, ejection port 162, shoulder 163, striker well 164, extractor well 166, striker safety well 168, cartridge cam 169, trigger bar cam 170, aperture 171, cover plate 172, bottom surface 173, grooves 174 and pocket 175. Surface 155 is located on the top portion of aperture 156. Surface 155, in the illustrated configuration, is slanted approximately 10 degrees relative to bore axis/center line CL of barrel 131, when barrel 131 is positioned in battery. This is best seen in FIG. 7. The bore axis/center line CL of barrel 131 is defined as the axis of rotation of the primary internal surfaces of the barrel. Surface 157 is located on the bottom portion of aperture 156 and can be cut substantially parallel to bore axis/center line CL of barrel 131, when barrel 131 is positioned in battery.

Figure 32:
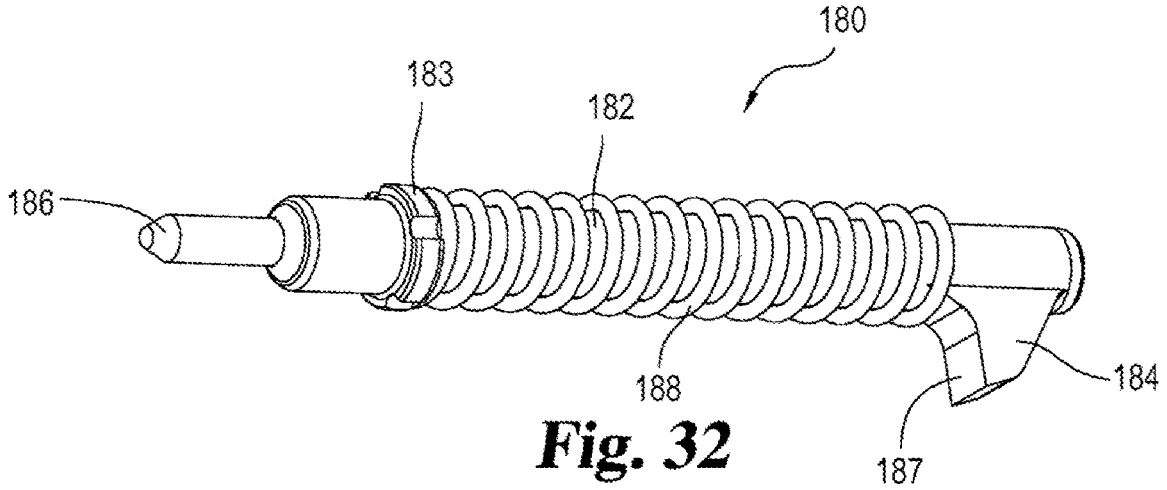
FIG. 32 is a perspective view of a striker assembly of the current embodiment of the slide barrel assembly of FIG. 23.

FIG. 32 illustrates the improved striker assembly 180 of the present invention. More particularly, striker assembly 180 generally includes striker 182, shoulder 183, striker catch 184, striker spring retainer 185, firing pin 186 and spring 188. Striker catch 184 defines surface 187. Striker 182 is reciprocally movable along a striker axis defined by striker well 164 in slide 152. In the illustrated pistol 100, striker axis lies along and is substantially parallel to bore axis/center line CL of bore 132.

Figure 33:
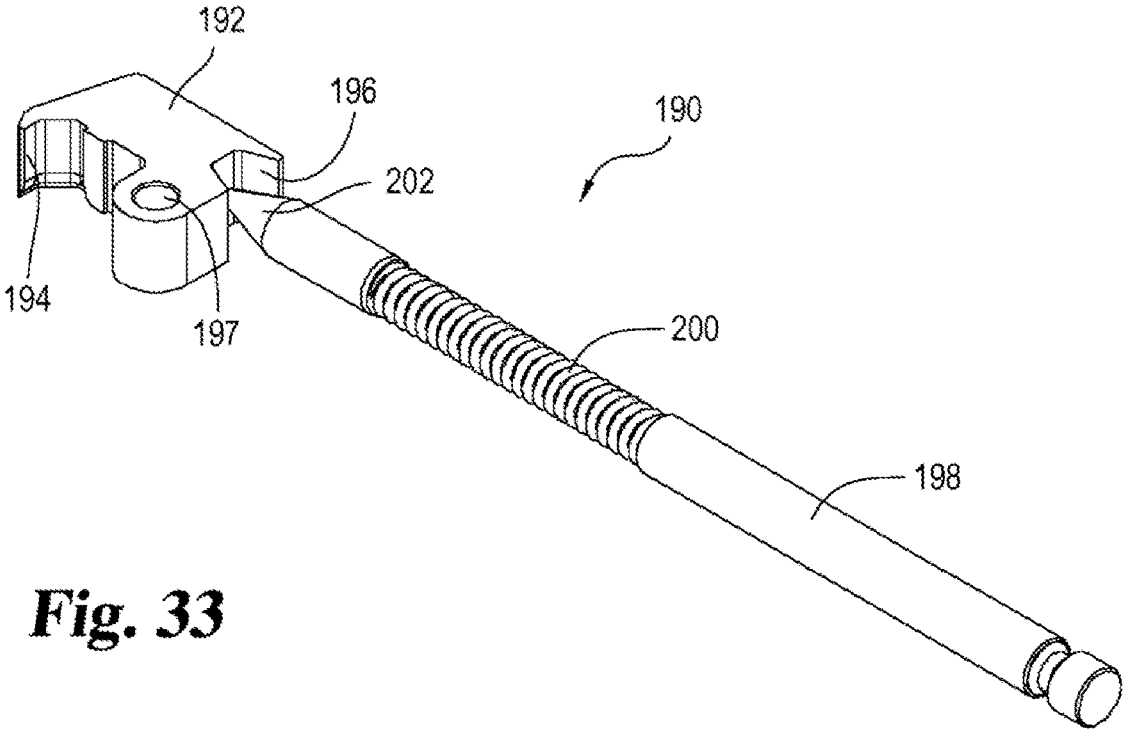
FIG. 33 is a perspective view of an extractor assembly of the current embodiment of the slide barrel assembly of FIG. 23.

FIG. 33 illustrates the improved extractor assembly 190 of the present invention. More particularly, extractor assembly 190 generally includes extractor 192, body 198, spring 200 and tip 202. Extractor assembly 190 includes claw 194, recess 196 and defines pivot point 197.

Figure 23:
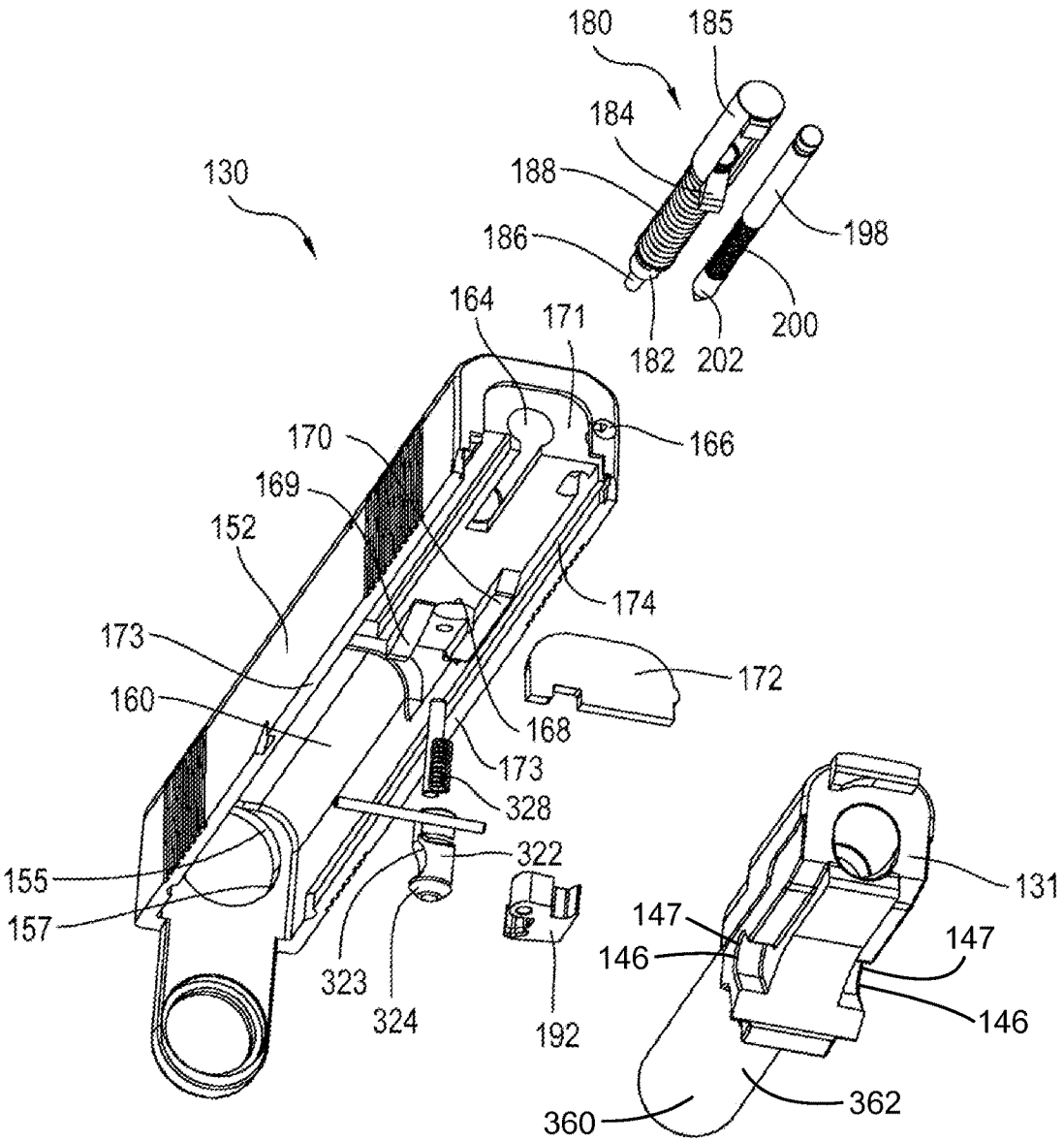
FIG. 23 is a bottom perspective exploded assembly view of a slide barrel assembly of the current embodiment of the semi-automatic pistol of FIG. 1.
Figure 24:
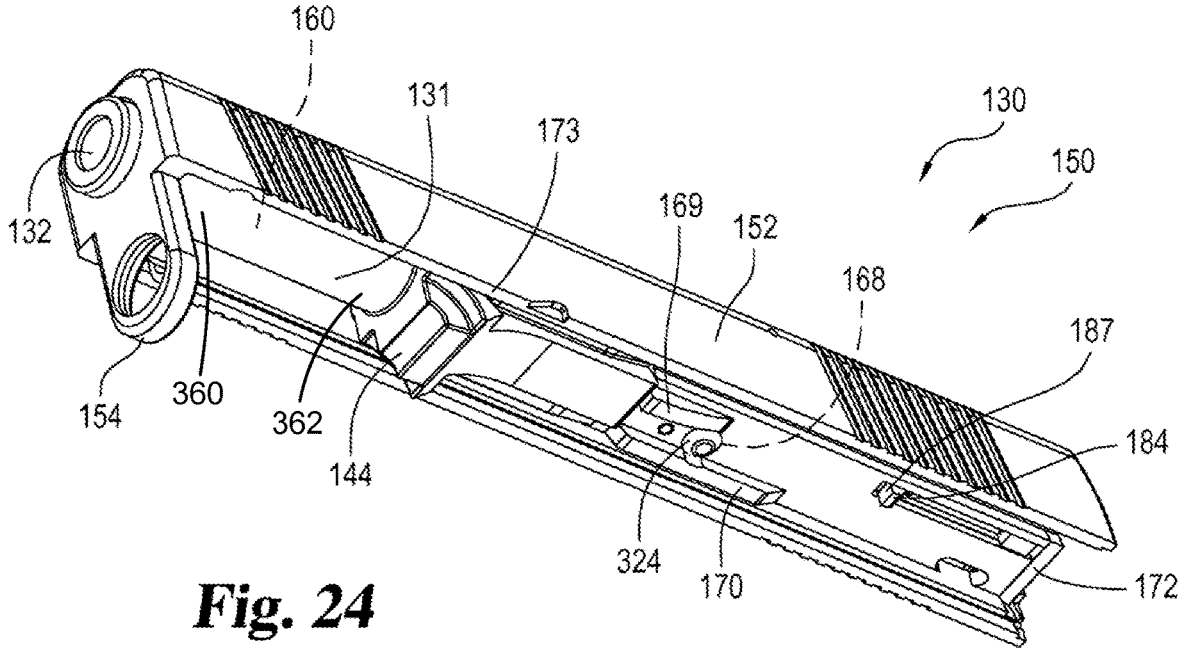
FIG. 24 is a bottom perspective view of the slide barrel assembly of FIG. 23.
Figure 25:
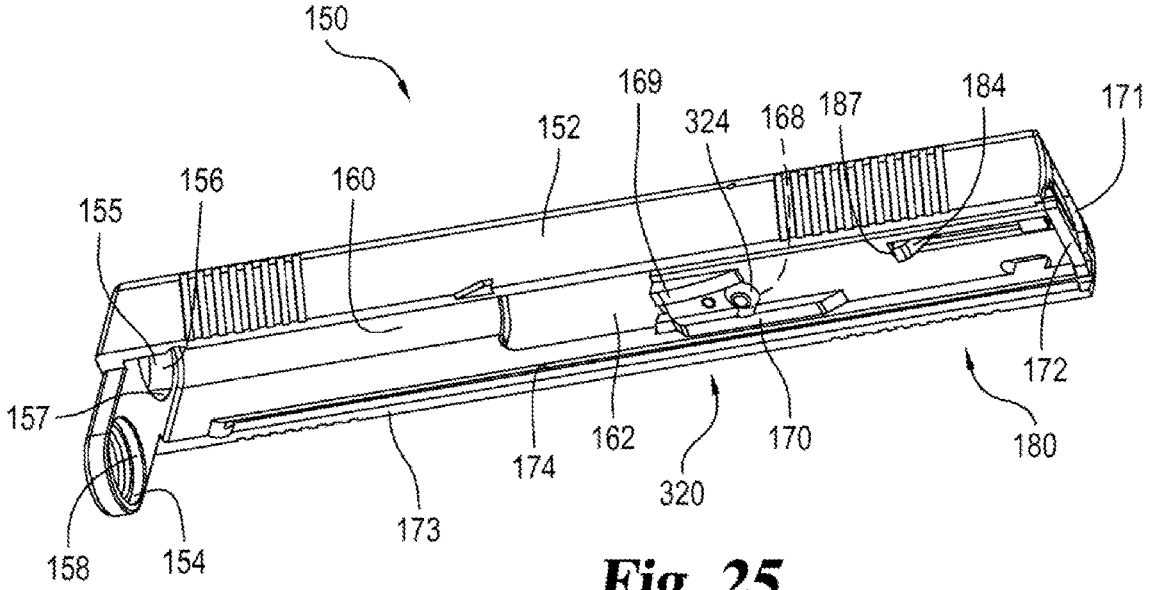
FIG. 25 is a bottom perspective view of a slide assembly of the current embodiment of the slide barrel assembly of FIG. 23.
Figure 26:
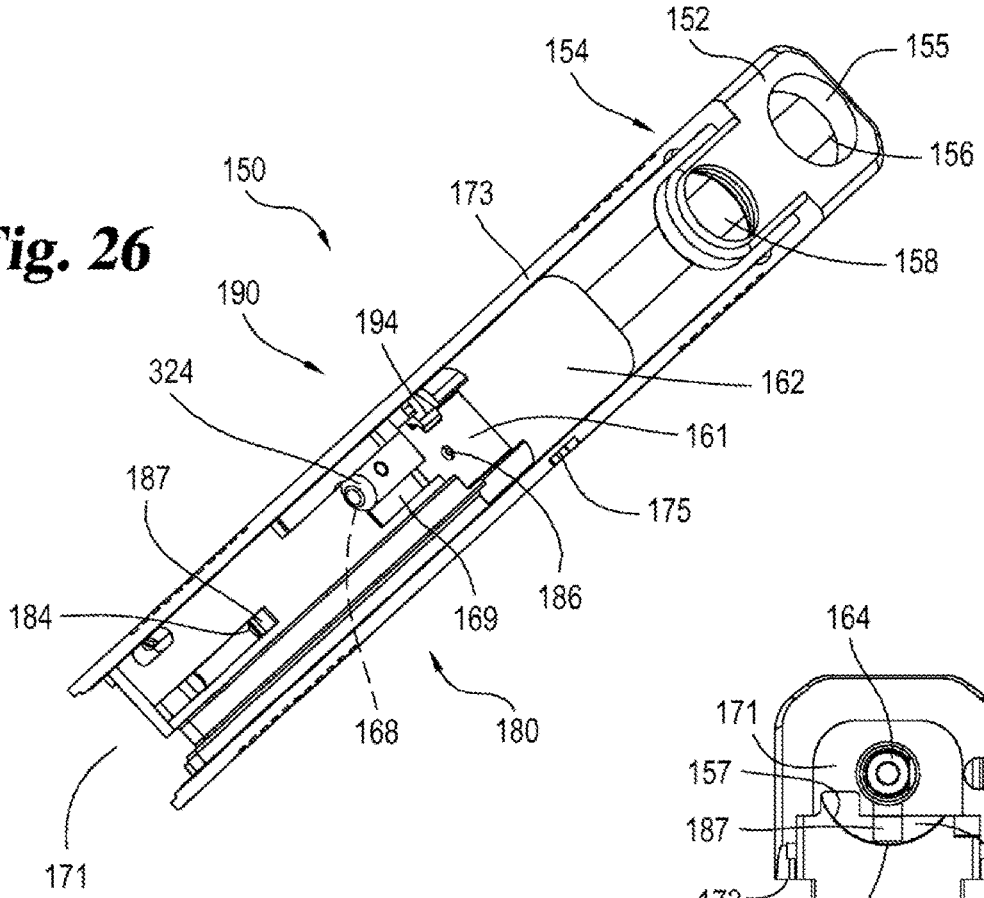
FIG. 26 is a bottom perspective view of the slide assembly of FIG. 25.

As best seen in FIG. 23, striker safety 320 includes plunger 322 that defines aperture 323 and cam surface 324 and spring 328. Striker safety 320 is configured to selectively block firing pin 186 from reaching chamber 134.

Slide barrel assembly 130 is slidingly engaged with receiver 101 with grooves 174 on slide assembly 150 slidingly engaged in grooves 126 on frame 102. Frame 102 defines a pair of opposed upper sidewalls, each having an upper/top edge 125 that can abut or nearly abut bottom surface 173 on slide 152 in a sliding relationship when slide barrel assembly 130 is slidingly engaged with receiver 101. At least a portion of the cam pins/trunnions 122 and 123 is positioned above the level of the upper/top edges 125 of the frame upper sidewalls. Grooves 126, which engage grooves 174 on slide assembly 150, are located above top edge 125. Slide barrel assembly 130 is retained on receiver 101 by takedown pin 230 which abuts shoulder 144 on barrel 131 and shoulder 149 which abuts face 161, preventing slide barrel assembly 130 from being removed from the muzzle end of receiver 101 when takedown pin 230 is in place. Slide assembly 150 reciprocates along the bore axis/center line CL between a forward in battery position and a rearward open position.

Slide latch 128 catches pocket 175 and holds slide assembly 150 in its rear-most position after firing the last cartridge 99 in magazine 210. A step on a magazine follower (not illustrated) pushes up on an inside lug protruding inwardly from slide latch 128, which moved slide latch 128 upwardly to engage pocket 175 on slide 152.

Barrel 131 resides in barrel well 160 of slide assembly 150 with breech end 133 abutting face 161 and muzzle end 138 extending through aperture 156 on slide 152. When slide assembly 150 moves rearwardly on receiver 101, shoulder 163 on slide assembly 150 interacts with shoulder 140 on barrel 131 causing barrel 131 to move with slide assembly 150 until cam pins/trunnions 122 and 123 abut cam path 147 in recesses 146 located on either side of protuberance 142 extending below barrel 131, which stops barrel 131 from continuing to move rearwardly with slide assembly 150. Upon contact between cam path 147 and trunnions 122 and 123, barrel 131 continues to translate both rearwardly and downwardly at an approximate 45 degree angle, guided by cam path 147, until trunnions 122 and 123 reach center of rotation CR, at which point barrel 131 stops translating rearwardly and subsequently only rotates in response to movement of slide assembly 150. When slide assembly 150 actuates forward and backward on receiver 101, trunnions 122 and 123 ride along cam paths 147 between the neutral position illustrated in FIG. 7 and center of rotation CR in recess 146. Note that the center of rotation CR of barrel 131 is located above top edge 125 of frame 102. The interface between trunnions 122 and 123 and cam path 147, as well as the interface between the outer surface of barrel 131 and surfaces 155 and 157 in aperture 156, control the relative tilt and position of barrel 131 as slide assembly 150 moves. When slide assembly 150 is fully retracted toward the rear of pistol 100, the outer surface of barrel 131 may substantially align with the incline of surface 155. When slide assembly 150 is in a neutral position, with breech 133 closed, the outer surface of barrel 131 may substantially align with and rest upon surface 157.

In a neutral position such as that illustrated in FIG. 7, where slide assembly 150 is positioned at a base location relative to receiver 101, barrel 131 is entrapped between takedown pin 230 and face 161 on slide 152. Barrel 131 may also rest on surface 157 in aperture 156 in the neutral position shown in FIG. 7. Recoil spring assembly 220 includes a helical recoil spring 350 that defines a spring axis 348 that is parallel to the bore axis/center line CL. Recoil spring 350 defines a bore 372 receiving a guide rod 352. Guide rod 352 defines a guide rod axis 354. Recoil spring assembly 220 dissipates recoil forces and provides constant compression that biases the slide assembly 150 to the forward battery position and generates a consistent lock up position for barrel 131 relative to receiver 101 every time the action closes. When takedown pin 230 is removed, clearance 148, riding on trunnions 122 and 123, guides barrel 131 when slide barrel assembly 130 is removed or inserted on receiver 101.

Trigger bow assembly 270 is positioned within frame 102 with bow 274 positioned in grooves 121 on frame 102. This permits trigger bow assembly 270 to move forward and back and relative to frame 102 while being substantially constrained from any angular motion or any motion up and down or side to side relative to frame 102. In cooperation bow 274 and grooves 121 restrict trigger 272 to a substantial single degree of freedom relative to frame 102. Spring 282 biases trigger bow assembly 270 forward against the direction of depression of trigger 272. This arrangement may replicate the straight pull of a Model 1911 trigger. Emulation of a Model 1911 trigger is highly desirable for the reasons described previously relating to the consistency of the trigger's draw and break.

Trigger bar 290 can be coupled to trigger bow assembly 270 at pivot point 292. Pin 308 passes through hole 280 and pivot point 292 to facilitate pivotal motion of trigger bar 290 relative to trigger bow assembly 270. Tongue 304 on trigger bar 290 rides on plunger 306, which limits the angular motion of trigger bar 290 while allowing trigger bar 290 to translate forward and back with trigger bow assembly 270. Plunger 306 includes a biasing structure, such as a spring, which biases trigger bar 290 upwardly to the position illustrated in FIG. 7. Safety cam 300 is arranged to be aligned with cam surface 324 on slide assembly 150 when trigger 272 is depressed relative to frame 102.

Sear recess cam 302 is constructed and arranged to align with trigger bar cam 170 on slide assembly 150 when slide assembly 150 translates rearwardly with respect to frame 102, such as during loading or reloading. Trigger bar cam 170 impinges upon sear reset cam 302 and forces trigger bar 290 to pivot downwardly against the bias of plunger 306.

Tongue 304 on trigger bar 290 may abut notch 243 on sear 242. When sear reset cam 302 interacts with trigger bar cam 170 and deflects trigger bar 290 downwardly against plunger 306. Tongue 304 can be moved out of contact with notch 243 and sear 242, which allows sear 242 to return to a neutral position under the biasing force of spring 254.

As shown in FIG. 23, striker assembly 180 is movably positioned in striker well 164 in slide 152 with striker catch 184 and surface 187 extending below striker well 164 for potential engagement with sear catch 246 and surface 247 on sear 242. When striker catch 184 is engaged with sear catch 246, spring 188 is compressed between shoulder 183 on striker 182 and striker spring retainer 185 positioned in striker well 164 behind striker 182. Pulling trigger 272 relative to frame 102 causes tongue 304 to impinge on sear 242 and presses sear catch 246 against striker catch 184, pushing striker 182 rearwardly in striker well 164 and compressing spring 188 until the (relative) angular movement of sear 242 in sear block 248 lowers sear catch 246 below striker catch 184 and causes surface 247 on sear catch 246 to disengage from surface 187 on striker catch 184, which causes spring 188 to propel firing pin 186 forward, potentially into contact with the primer on a cartridge 99 positioned in chamber 134. While impinging upon and moving sear 242 in sear block 248, tongue 304 can be captured in notch 243, causing trigger bar 290 to pivot about pivot point 292 and to deflect downwardly so that tongue 304 matches the relative vertical movement of sear 242.

When trigger 272 is pulled relative to frame 102 and safety cam 300 engages cam surface 324 on striker safety 320, safety cam 300 forces plunger 322 to move upwardly relative to slide assembly 150 until aperture 323 on plunger 322 substantially aligns with the outer diameter of striker assembly 180 and shoulder 183, thereby permitting striker 182 to move past aperture 323 and allowing firing pin 186 to impact a primer on cartridge 99 positioned in chamber 134. When trigger 272 has not been pulled and safety cam 300 does not engage cam surface 324, spring 328 biases plunger 322 downwardly such that aperture 323 does not align with and blocks striker assembly 180 from passing and blocks firing pin 186 from impacting a primer on cartridge 99 positioned in chamber 134.

Sear assembly 240 includes sear 242 movably positioned in sear block 248 with spring 254 biasing sear 242 away from sear block 248. This movement is limited by projections 244 on sear 242 that reside in grooves 252 in sear block 248 and constrain sear 242 to move substantially in a single direction relative to sear block 248. Force exerted on sear block 248 at notch 243 by tongue 304 of trigger bar 290 causes sear 242 to move both laterally, substantially in the direction of movement of trigger bar 290 and downwardly away from slide 152 and striker catch 184. As best shown in FIG. 7, with sear assembly 240 fixedly coupled to frame 102, grooves 252 are angled at angle A from bore axis/center line CL of barrel 131. In the illustrated configuration, striker 182 moves along an axis that approximately corresponds to bore axis/center line CL, so groove 252 are also at angle A compared to the direction that striker catch 184 moves. In the illustrated configuration, angle A is approximately 21 degrees. In other configurations, angle A can be between approximately 15 degrees and approximately 25 degrees. In yet other configurations, angle A can be between approximately 10 degrees and approximately 30 degrees. When sear 242 has been moved a sufficient distance, sear catch 246 resides below striker catch 184 and striker catch 184 is released to act under the biasing force of spring 188.

When trigger 272 is pulled and sear 242 moves down grooves 252 at angle A relative to striker catch 184, surface 247 on sear catch 246 both pushes surface 187 on striker catch 184 rearwardly and slides downwardly along surface 187 until surface 247 disengages from surface 187 as described above. The sliding action between surfaces 187 and 247 can be transmitted as "feel" to the shooter pulling trigger 272 (through trigger bar 290 and trigger bow assembly 270) leading up to the release of striker 182. Surface 247 on sear catch 246 and/or surface 187 on striker catch 184 can be modified, for example by hardening, grinding, polishing, etc. to modify the "feel" of this relative motion. The relative amount that surfaces 187 and 247 overlap can be adjusted to modify the duration of the relative shearing movement between them before releasing striker 182.

Wear on surface 187 on striker catch 184 and surface 247 on sear catch 246 can be minimized because these surfaces may maintain a consistent orientation relative to each other. In the illustrated embodiment, surfaces 187 and 247 are oriented substantially parallel. The components of pistol 100 can be constructed and arranged to maintain the substantial parallel orientation of surface 187 and 247 regardless of the relative position of striker 182 and/or sear 242.

Figure 35:
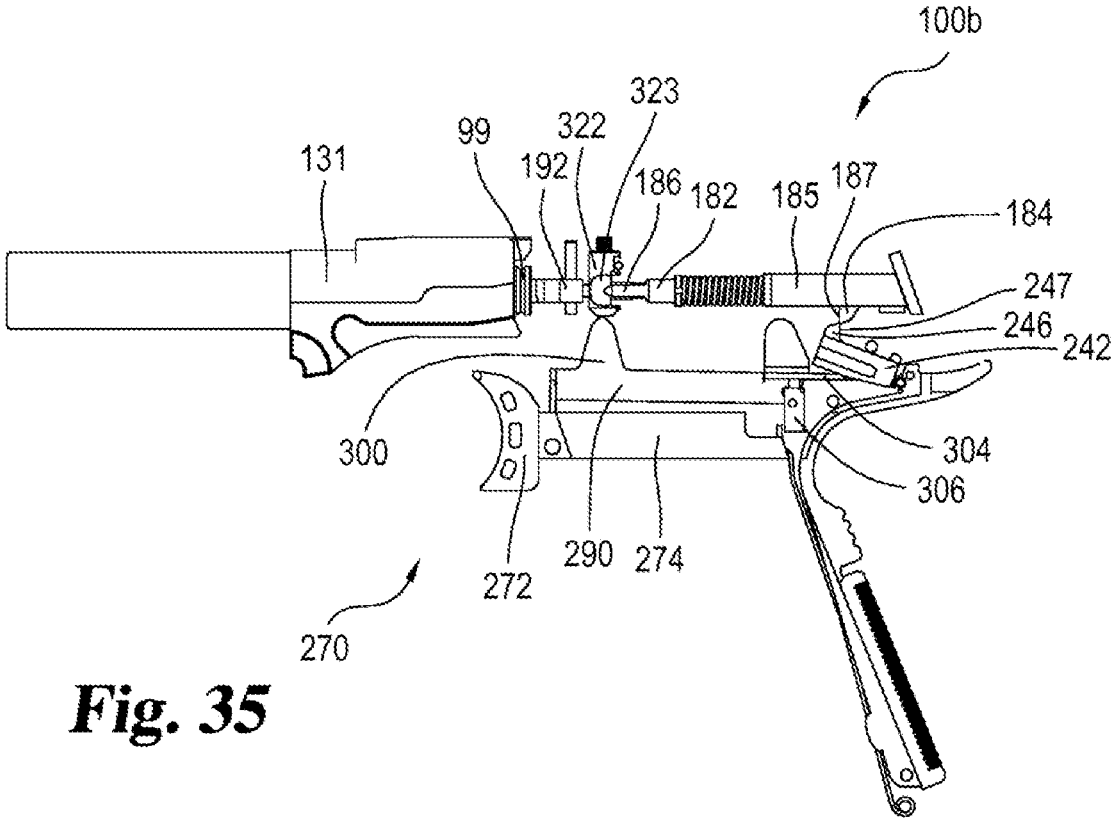
FIG. 35 is a left-side elevational view of select components of the current embodiment of the semi-automatic pistol of FIG. 1 illustrating the components as the trigger is pulled and the striker is released.

Furthermore, upon reaching the release point (as shown in FIG. 35), the striker is released, which removes the biasing force imparted by spring 188 from being transmitted to trigger 272 through trigger bow assembly 270 and trigger bar 290. As described below, a significant portion of the "pull" force of trigger 272 may come from biasing spring 188. In some embodiments, over half the "pull" force may come from biasing spring 188. Thus, when striker 182 is released, the "pull" felt by the shooter may reduce substantially. This may provide a distinct and repeatable "feel" to the shooter an instant before pistol 100 actually fires. Such tactile feedback can be useful to some shooters.

Sear block 248 can be secured relative to frame 102 by a plurality of pins such that sear block 248 substantially cannot be moved relative to frame 102 while assembled.

Ejector 256 is attached to sear block 248 and positions ejector tip 258 to impact expended brass case being extracted from chamber 134 to help eject the expended brass case from pistol 100 when slide barrel assembly 130 actuates as is known in the art.

Trigger safety 310 includes bar 312 that passes through frame 102 and includes recess 314 positioned substantially in the middle of bar 312 and levers 316 and 318 positioned externally on frame 102 and coupled to bar 312 such that rotation of levers 316 or 318 results in comparable rotation of bar 312. Recess 314 is constructed and arranged to permit passage of safety catch 278 on trigger bow assembly 270 when levers 316 and 318 are positioned in the firing position. When levers 316 and 318 are positioned in a safe position, bar 312 and recess 314 are constructed and arranged to block passage of safety catch 278, thereby prevent trigger bow assembly 270 and trigger 272 from being moved relative to frame 102 at least through its full range of motion.

Magazine release assembly 330 is positioned in frame 102 with button 334 protruding from frame 102 on either side of trigger recess 110. Actuating either side of button 334 moves tapered recess 336 relative to detent ball 338 and pushes detent ball 338 downwardly against ramp 341 on linkage 340, causing relative movement of linkage 340 in the direction indicated by the arrow relative to frame 102. This movement of linkage 340 similarly moves projection 342 laterally in the direction of the indicated arrow, which can bring projection 342 out of engagement with catch 212 on magazine 210, thereby permitting the removal of magazine 210 from frame 102.

The structure shown in magazine release assembly 330 advantageously allows for ambidextrous operation of button 334 to release magazine 210. In addition, linkage 340 permits projection 342 to be positioned spaced apart by any desired distance from button 334, permitting pistol 100 to be configured to work with a variety of different designs of magazines 210 that may have catch 212 positioned in different positions relative to frame 102. This allows button 334 to be positioned optimally relative to trigger 272 for operation by a user gripping pistol 100 in a conventional manner.

Recoil spring assembly 200 is entrapped between projection 154 and frame 102. Aperture 158 permits portions of recoil spring assembly 220 to project forward of projection 154 when slide 152 moves rearwardly relative to frame 102 during loading or reloading. Pistol 100 is constructed and arranged such that when barrel 131 is in battery and pistol 100 is ready to be fired, barrel 131 is entrapped between takedown pin 230 and slide 152 to provide an in battery position for pistol 100 that is repeatable and essentially free of slack.

Recoil spring assembly 220 is positioned forward of trigger 272 within the frame 102 in recoil spring well 116 with trigger plane TP passing through recoil spring assembly 220. Similarly, recoil spring assembly 220 can be positioned entirely below the downwardly facing upper/top surface 111 of trigger recess 110 and entirely below the bore axis/center line CL. Guide rod 352 can be positioned entirely below the barrel 131, and guide rod axis 354 can be positioned entirely below the level of the upper/top surface 111 of trigger recess 110. The entire guide rod 352 can be at a level below the upper/top surface 111 of trigger recess 110 when the bore axis/center line CL is horizontal. The entire guide rod 352 can be forward of the trigger guard. In another embodiment (not illustrated), a majority of recoil spring assembly 220 can be positioned below top surface 111 of trigger recess 110. Conventional pistols position the recoil spring above the trigger 272. Positioning recoil spring assembly 220 forward of trigger 272 instead of above the trigger. As a result, torque about a shooter's wrist is reduced, thereby redirecting some of the recoil force straight rearward into a user's major muscle groups. Redirecting more recoil force straight rearward reduces rotation of the pistol 100, thereby greatly decreasing the need to adjust the pistol 100 to reacquire the target prior to firing each follow-up shot.

Trunnions 122 and 123 extend from frame 102, with portions of trunnions 122 and 123 positioned above top edge 125 of frame 102. In addition, protuberance 142 extends well away from bore axis/center line CL of bore 132 with center of rotation CR in recess 146 residing below bore 132. When barrel 131 is positioned in battery, trunnions 122 and 123 are positioned below bore 132. This configuration reduces the distance between bore axis/center line CL of bore 132 and a center of mass of pistol 100. As a result, recoil force resulting from the discharge of the pistol 100 is directed straight rearward into a user's major muscle groups rather than upward and rearward above a user's wrist. Directing the recoil force straight rearward reduces rotation of the pistol 100, thereby greatly decreasing the need to adjust the pistol 100 to reacquire the target prior to firing each follow-up shot.

Referring now to FIGS. 34-39, 44-49, and 50-55, select components of pistol 100 and cross-sectional views of pistol 100 are illustrated to show various stages in the action cycle of pistol 100 including stages 100*a*, 100*b*, 100*c*, 100*d*, 100*e* and 100*f*. Stage 100*a* shows pistol 100 in battery with cartridge 99 in chamber 134 and trigger 272 in a neutral position. Stage 100*b* shows a cartridge in battery and trigger 272 pulled sufficiently to fire pistol 100. Stage 100*c* shows a cartridge in battery and firing pin 186 impacting the primer in cartridge 99. Stage 100*d* shows pistol 100 shortly after firing with slide assembly 150 moved rearwardly with respect to chamber 134 a sufficient distance that brass case 99A is extracted from chamber 134. Stage 100*e* shows slide assembly 150 fully retracted. Stage 100*f* shows slide assembly 150 partially returned towards an in battery configuration with a cartridge being stripped from magazine 210. FIGS. 44-49 show how the recoil spring assembly 220 compresses during the firing sequence. FIGS. 50-55 show the interaction between the cam paths 147 defined by recesses 146 on either side of the bottom of the barrel 131 (visible in FIG. 23) and the trunnions 122 and 123.

Figure 34:
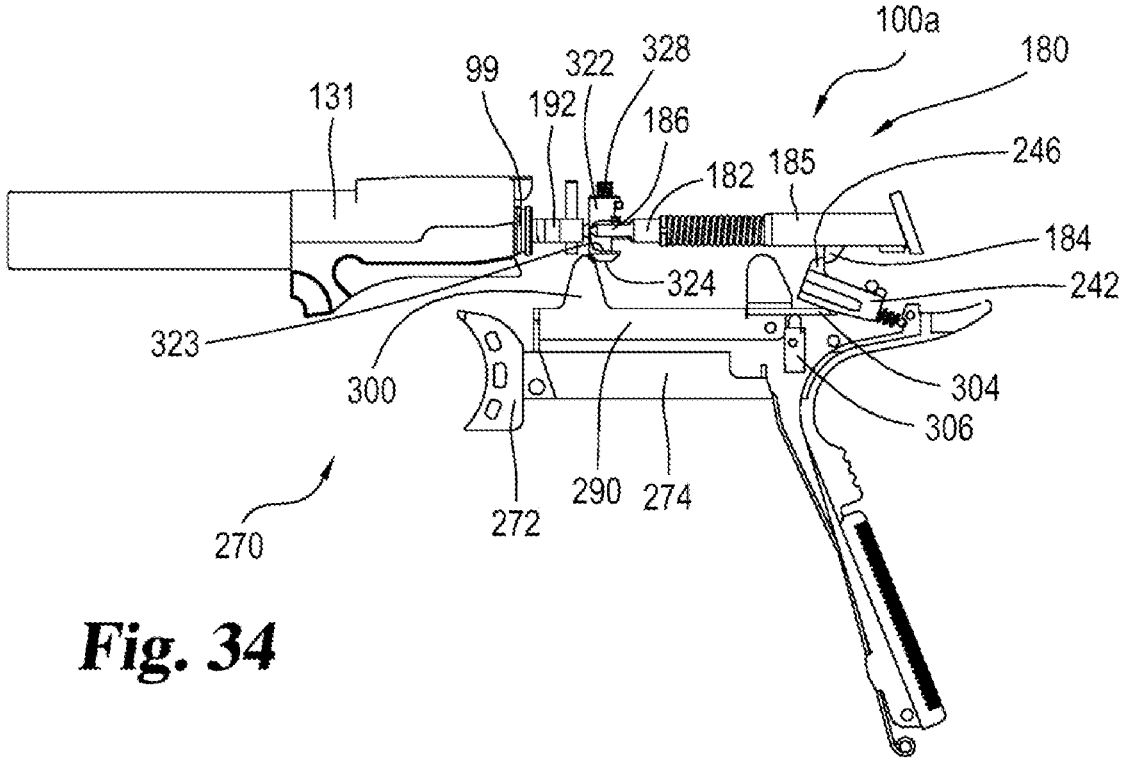
FIG. 34 is a left-side elevational view of select components of the current embodiment of the semi-automatic pistol of FIG. 1 illustrating a cartridge in battery in the barrel with the action assembly in a neutral position.
Figure 44:
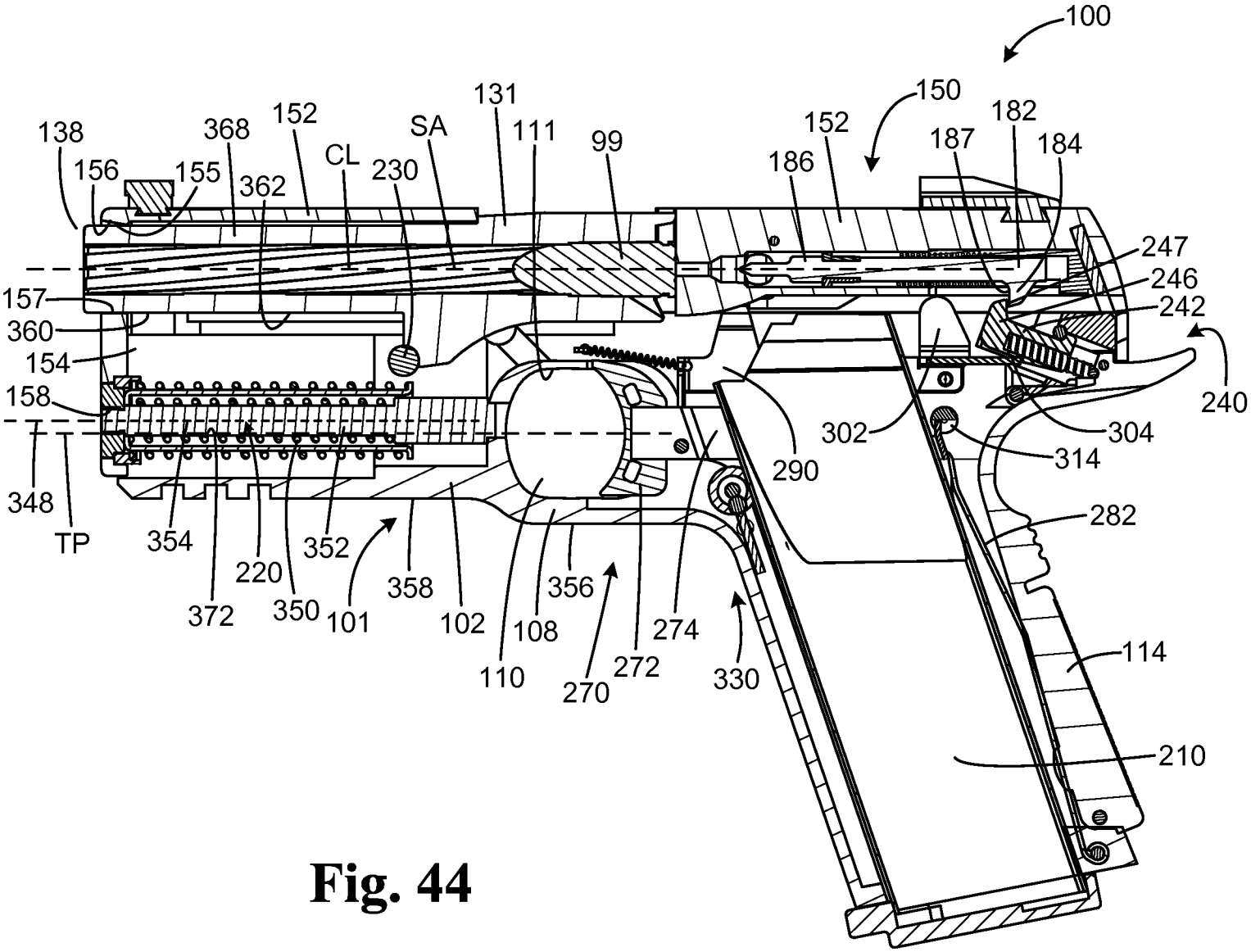
FIG. 44 is a left-side elevational cross-sectional view of the current embodiment of the semi-automatic pistol of FIG. 1 illustrating a cartridge in battery in the barrel with the action assembly in a neutral position.

Referring specifically to FIGS. 34, 44, and 50, stage 100*a* is shown with select components of pistol 100 including barrel 131, striker assembly 180, sear 242, trigger bow assembly 270, trigger bar 290 and striker safety 320 in FIG. 34, the pistol 100 in cross-section in FIG. 44, and the pistol 100 in cross-section with the left cam path 147 and trunnion 122 exposed in FIG. 50. As illustrated, pistol 100 is in battery with cartridge 99 in chamber 134, trigger 272 in a neutral position with safety cam 300 not contacting cam surface 324 and striker catch 184 abutting sear catch 246. Plunger 322 is deflected downward by spring 328 and aperture 323 is not aligned with the body of striker 182, effectively blocking firing pin 186 from contacting the primer on cartridge 99. Trigger bar 290 is positioned in a neutral position riding atop plunger 306 with tongue 304 abutting sear 242. In this position, sear catch 246 holds striker 182 in place and compresses spring 188. The slide assembly 152 and barrel 131 are in the forwardmost position, which places the recoil spring assembly 220 in the least compressed position. The trunnions are received in clearances 148 and are located behind recesses 146.

Figure 45:
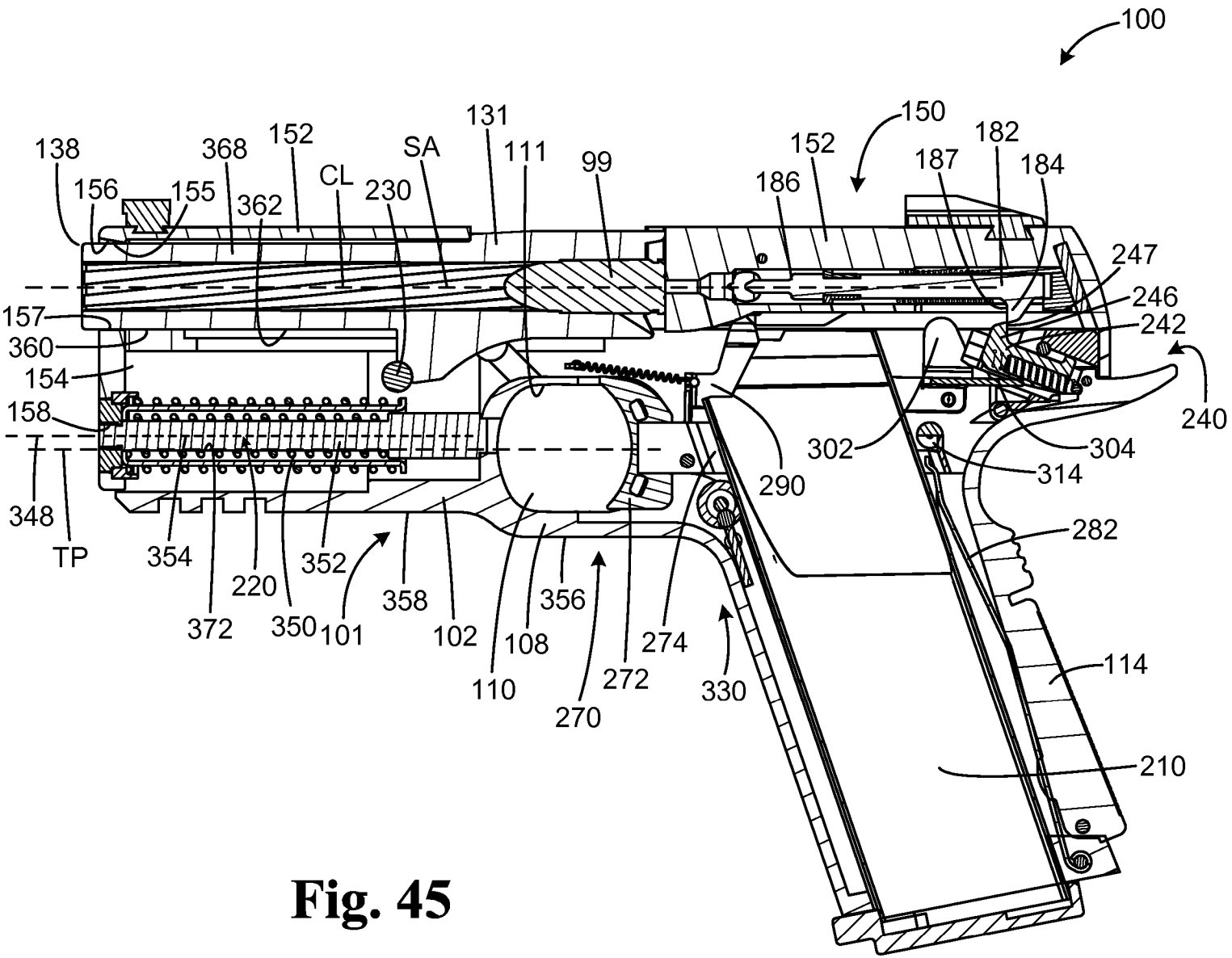
FIG. 45 is a left-side elevational cross-sectional view of the current embodiment of the semi-automatic pistol of FIG. 1 illustrating the pistol as the trigger is pulled and the striker is released.

Referring now to FIGS. 35, 45, and 51 stage 100*b* is shown with select components of pistol 100 including barrel 131, striker assembly 180, trigger bow assembly 270, trigger bar 290 and sear 242, the pistol 100 in cross-section in FIG. 45, and the pistol 100 in cross-section with the left cam path 147 and trunnion 122 exposed in FIG. 51. As illustrated, there is a cartridge in battery and trigger 272 is pulled to a firing position where striker 182 is released to potentially impact the primer on cartridge 99. As shown, sear catch 246 no longer abuts striker catch 184, releasing striker 182 and firing pin 186 to be impelled towards the primer on cartridge 99 by spring 188 pushing against striker spring retainer 185. Safety cam 300 abuts cam surface 324 and has moved plunger 322 upwardly against the biasing force of spring 328 with aperture 323 substantially aligned with the body of striker 182 such that striker 182 can travel pass plunger 322 to impact the primer on cartridge 99. The slide assembly 152 and barrel 131 remain in the forwardmost position, which places the recoil spring assembly 220 in the least compressed position. The trunnions are received in clearances 148 and are still located behind recesses 146.

Pulling trigger 272 from the neutral position illustrated in FIGS. 34, 44, and 50 to the firing position illustrated in FIGS. 35, 45, and 51 moves striker 182 rearwardly and further compresses spring 188. The "trigger pull," or resistance to pulling trigger 272, may include both compressing spring 188 and compressing spring 282 (that acts directly on trigger bow assembly 270). In a configuration having a trigger pull of approximately 5 pounds of force, over half that force may come from compressing spring 188. The compression of spring 188 by pulling trigger 272 may provide the majority of the energy that propels striker 182 toward the primer on cartridge 99.

Figure 36:
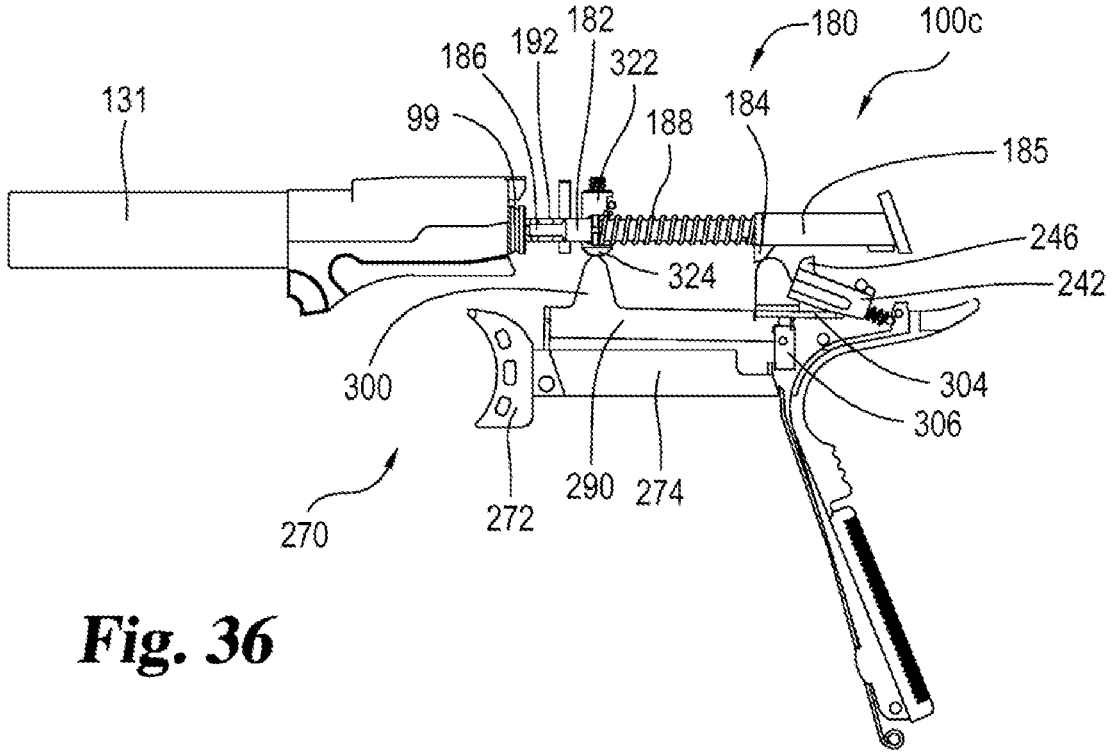
FIG. 36 is a left-side elevational view of select components of the current embodiment of the semi-automatic pistol of FIG. 1 illustrating the firing pin impacting a cartridge located in the chamber in the barrel.
Figure 46:
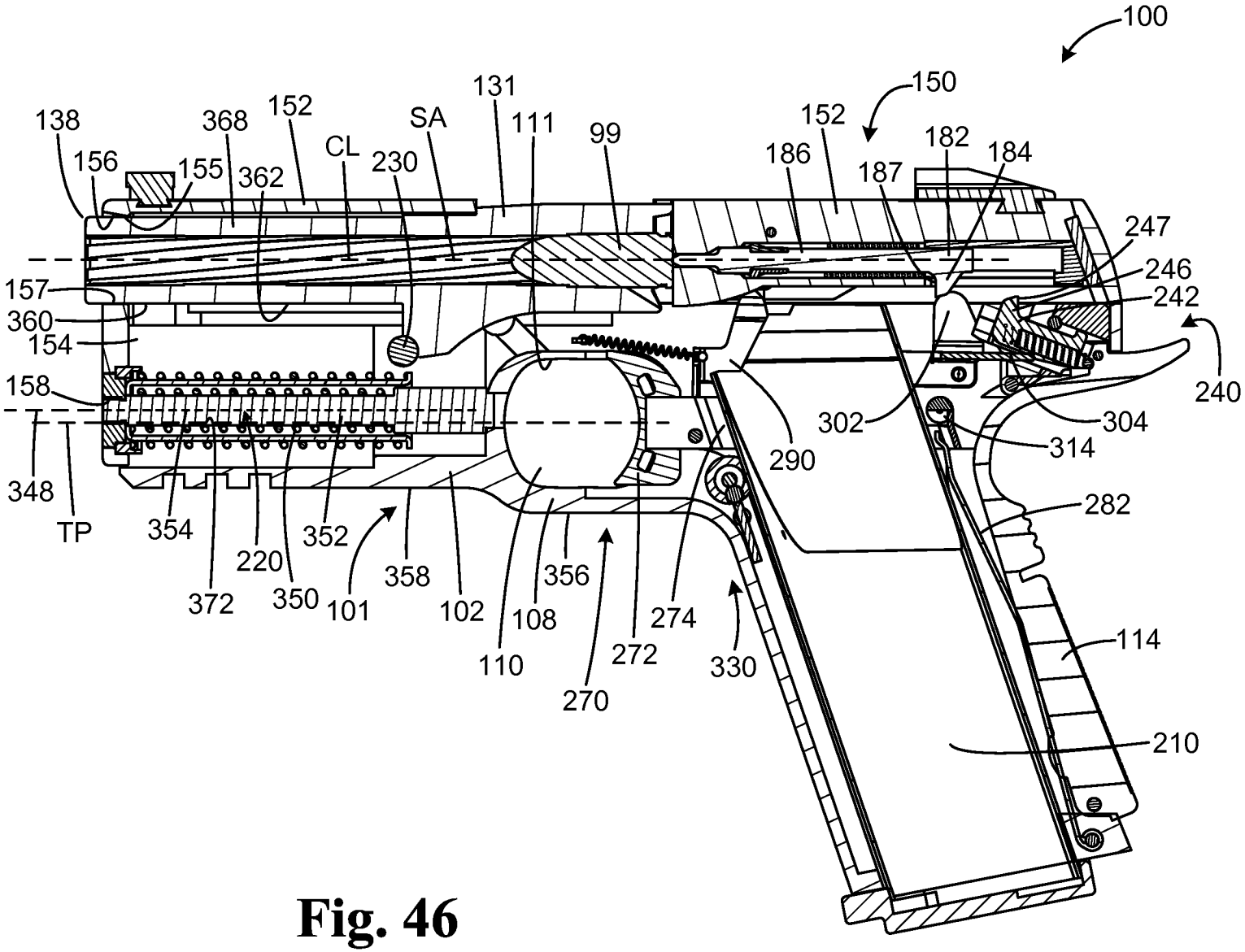
FIG. 46 is a left-side elevational cross-sectional view of the current embodiment of the semi-automatic pistol of FIG. 1 illustrating the firing pin impacting a cartridge located in the chamber in the barrel.

Referring now to FIGS. 36, 46, and 52 stage 100*c* is shown with select components of pistol 100 including barrel 131, striker assembly 180, trigger bow assembly 270, trigger bar 290 and sear 242, the pistol 100 in cross-section in FIG. 46, and the pistol 100 in cross-section with the left cam path 147 and trunnion 122 exposed in FIG. 52. As illustrated, cartridge 99 is in battery with firing pin 186 impacting the primer in cartridge 99. Trigger 272 remains pulled to a firing position. Safety cam 300 remains in contact on cam surface 324 maintaining plunger 322 in position with aperture 323 substantially aligned with striker 182 with striker 182 extending through plunger 322. Striker catch 184 is positioned forward of sear catch 246 with spring 188 expanded, having imparted its stored energy to striker 182 and firing pin 186. The slide assembly 152 and barrel 131 remain in the forwardmost position, which places the recoil spring assembly 220 in the least compressed position. The trunnions are received in clearances 148 and are still located behind recesses 146.

Figure 37:
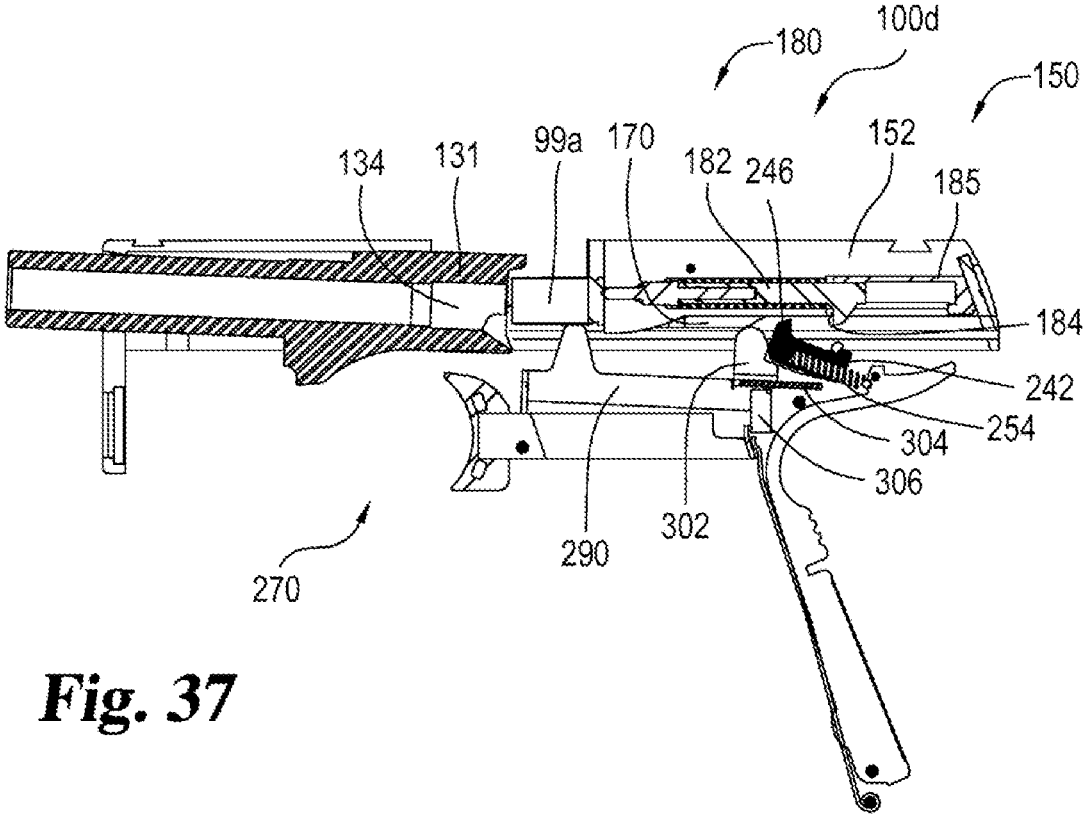
FIG. 37 is a left-side elevational view of select components of the current embodiment of the semi-automatic pistol of FIG. 1 illustrating partial blow back of the slide assembly after a cartridge has been fired and extraction of a brass case from the chamber in the barrel.
Figure 47:
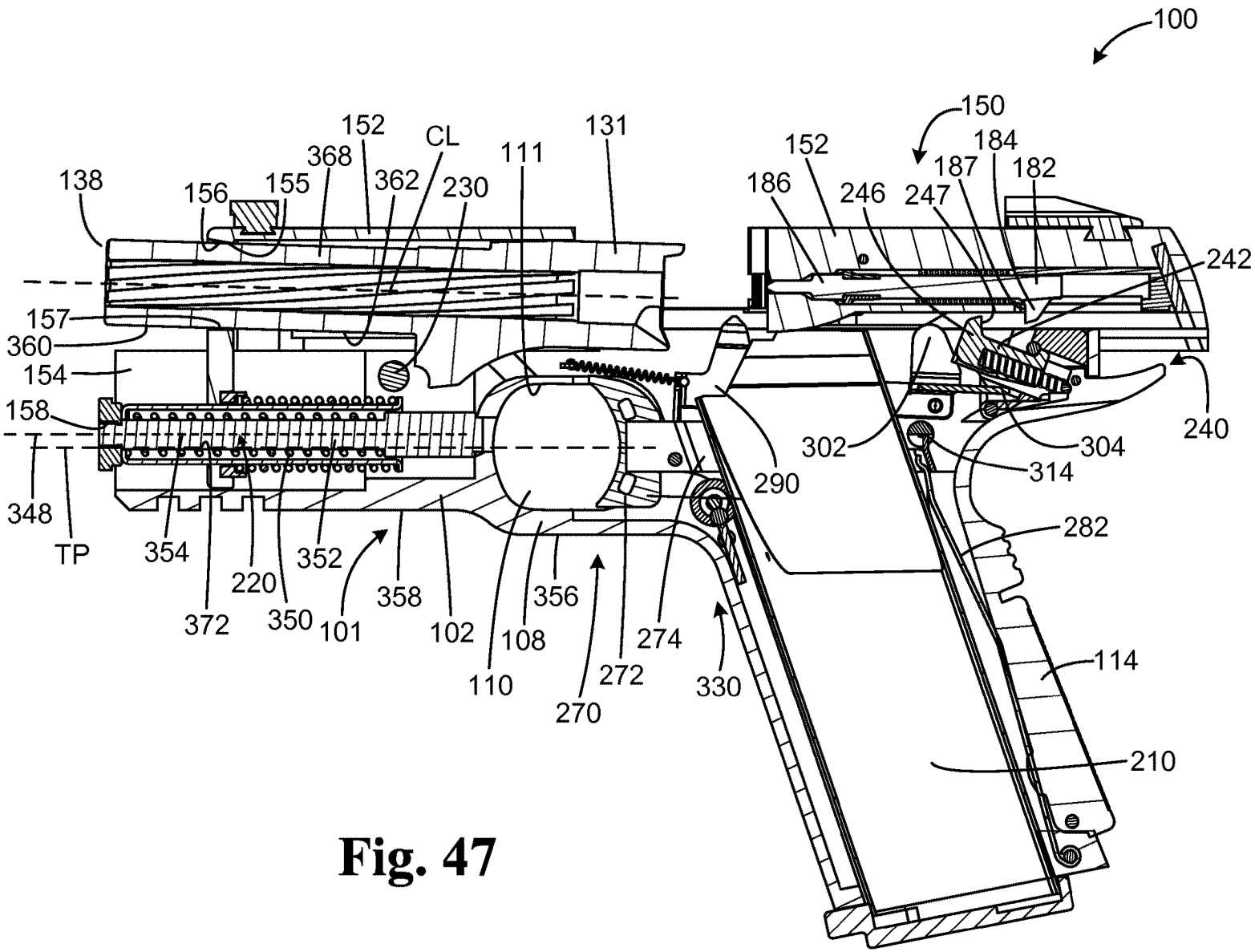
FIG. 47 is a left-side elevational cross-sectional view of the current embodiment of the semi-automatic pistol of FIG. 1 illustrating partial blow back of the slide assembly after a cartridge has been fired and extraction of a brass case from the chamber in the barrel.

Referring now to FIGS. 37, 47, and 53, stage 100*d* is shown with select components of pistol 100 illustrated in cross-sectional view along the bore axis/center line CL of pistol 100 including barrel 131, slide 152, striker assembly 180, trigger bow assembly 270, trigger bar 290 and sear 242, the pistol 100 in cross-section in FIG. 47, and the pistol 100 in cross-section with the left cam path 147 and trunnion 122 exposed in FIG. 53. After cartridge 99 has been fired, recoil energy imparted to slide assembly 150 has moved slide assembly 150 rearwardly with respect to chamber 134 a sufficient distance to extract brass case 99A from chamber 134. While not illustrated, claw 194 is engaged with the rim on brass case 99A so that brass case 99A moves with slide assembly 150 during this phase of extraction. In the illustrated position, trigger 272 remains pulled, but sear reset cam 302 abuts trigger bar cam 170 deflecting trigger bar 290 downwardly against plunger 306 disengaging tongue 304 from sear 242. Sear 242, acting under the biasing force of spring 254, has returned to a neutral position and striker catch 184, due to the movement of slide 152, is positioned rearwardly of sear catch 246. Barrel 131, restrained from moving with slide assembly 150 because of the interaction between trunnions 122 and 123 and cam path 147, has begun to tilt with trunnions 122 and 123 following cam path 147. Recoil spring assembly 220 has also been compressed by the rearward movement of the slide assembly 150.

Figure 38:
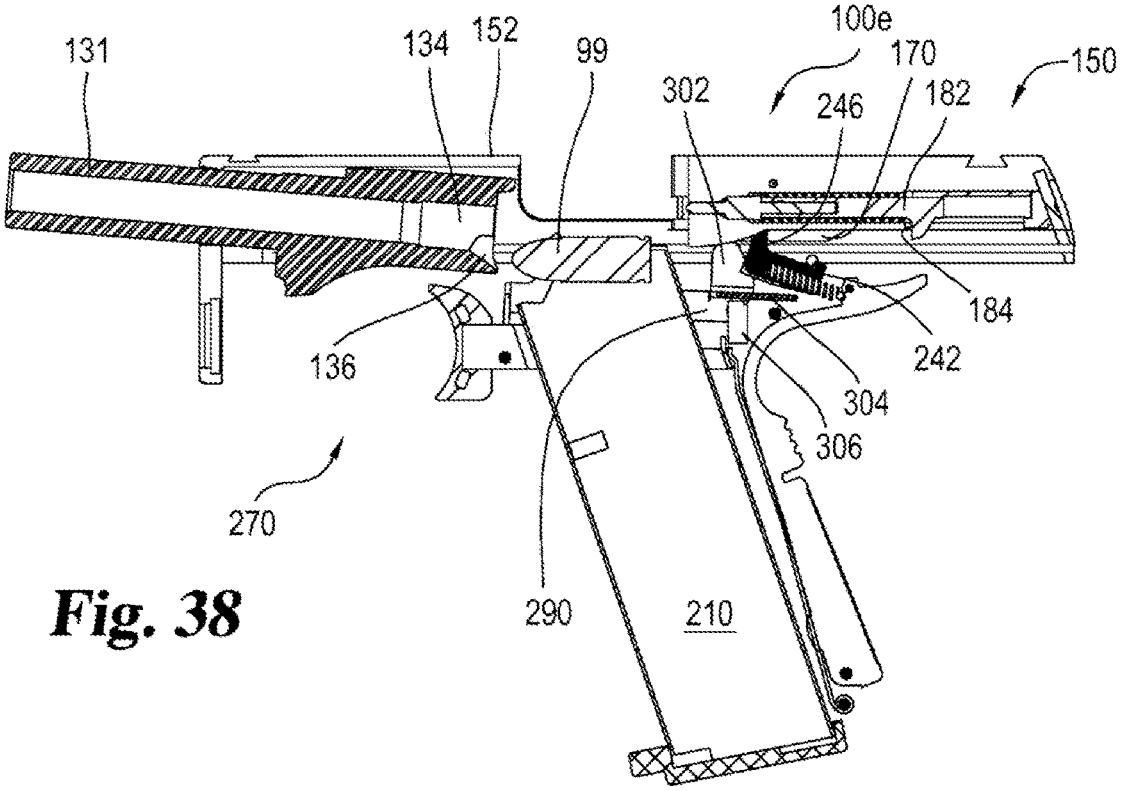
FIG. 38 is a left-side elevational view of select components of the current embodiment of the semi-automatic pistol of FIG. 1 illustrating the slide assembly full retracted and the chamber open with a cartridge positioned for reloading.
Figure 48:
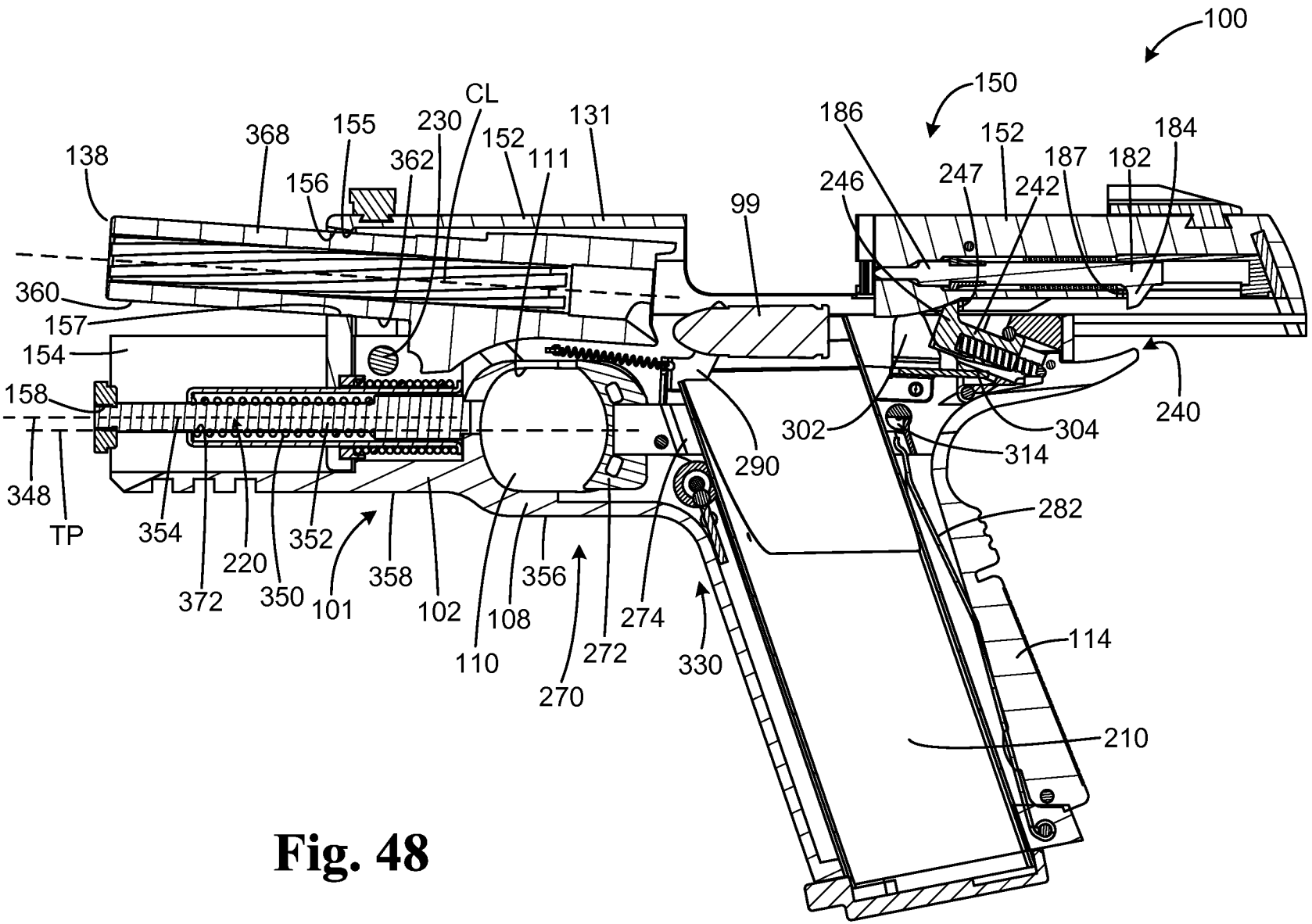
FIG. 48 is a left-side elevational cross-sectional view of the current embodiment of the semi-automatic pistol of FIG.

Referring now to FIGS. 38, 48, and 54 stage 100*e* is shown with select components of pistol 100 illustrated in cross-section along the bore axis/center line CL of pistol 100 including barrel 131, slide assembly 150, magazine 210, trigger bow assembly 270, trigger bar 290 and sear 242, the pistol 100 in cross-section in FIG. 48, and the pistol 100 in cross-section with the left cam path 147 and trunnion 122 exposed in FIG. 54. Trigger 272 remains pulled and slide assembly 150 is fully retracted under the recoil force imparted by the firing of the previous cartridge and is beginning the return stroke under the biasing force of recoil spring assembly 220, which is fully compressed. In magazine 210, a subsequent cartridge 99 is advanced to the top of the magazine, barrel 131 has moved as far rearwardly as possible with trunnions 122 and 123 positioned in recess 146 on barrel 131, and with the outer surface of barrel 131 restrained in aperture 156 by surface 157, barrel 131 is tilted with chamber 134 inclined toward cartridge 99 in magazine 210. The tip of cartridge 99 is aligned with ramp 136 on barrel 131 to aid loading of cartridge 99 into chamber 134 and sear reset cam 302 continues to ride on trigger bar cam 170 keeping tongue 304 deflected below sear 242.

During the later stages of the firing cycle, after pistol 100 has been fired, the shooter may continue to hold the trigger 272 in a depressed (firing) position. As long as trigger 272 remains depressed, tongue 304 will remain below sear 242 and disengaged from notch 243. After firing, as soon as the shooter releases trigger 272, trigger bow assembly will return to its neutral position due to the biasing force exerted by spring 282 and tongue 304 will return to its neutral position in notch 243 due to the biasing force exerted by plunger 306, resetting trigger bow assembly 270, trigger bar 290 and sear assembly 240 to their neutral position, ready to fire again, as illustrated in FIG. 34.

Figure 39:
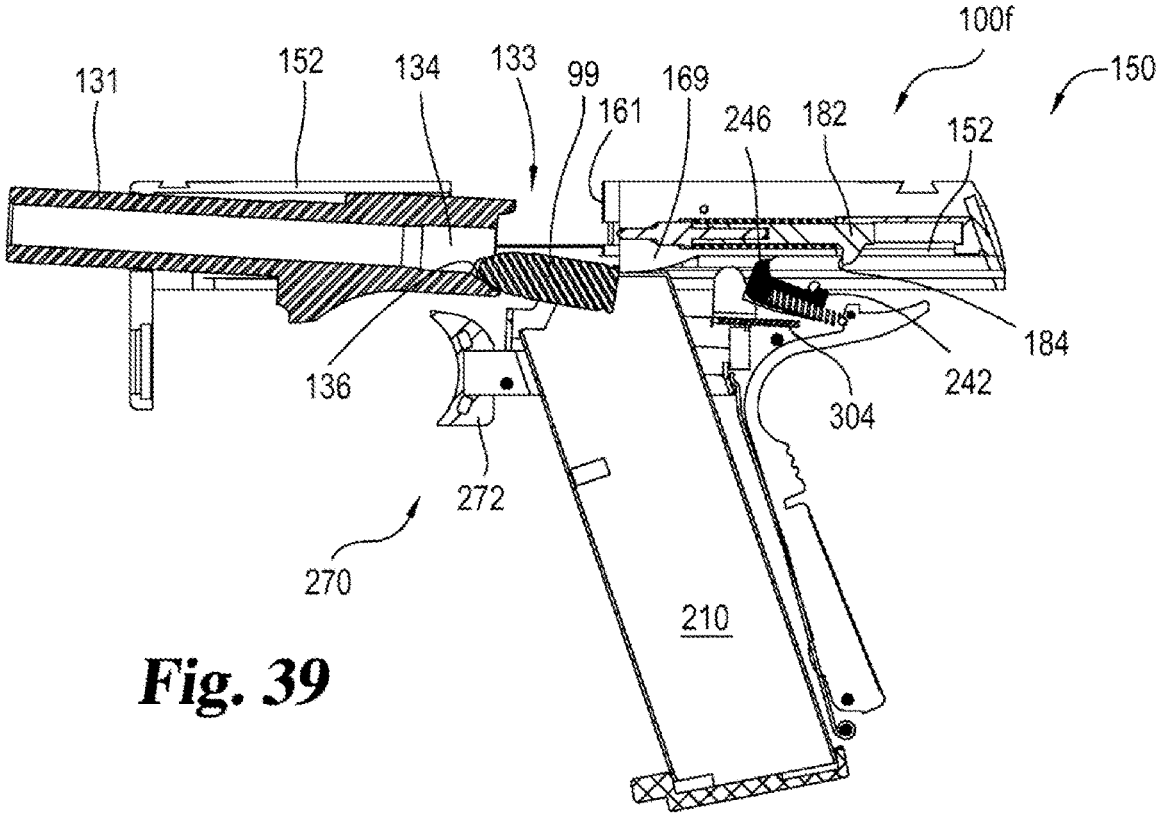
FIG. 39 is a left-side elevational view of select components of the current embodiment of the semi-automatic pistol of FIG. 1 illustrating a cartridge being stripped by the slide and entering the chamber in the barrel.

Referring now to FIGS. 39, 49, and 55, stage 100*f* is shown with select components of pistol 100 illustrated in cross-section along the center line of pistol 100 including barrel 131, slide assembly 150, magazine 210, trigger bow assembly 270, trigger bar 290 and sear 242, the pistol 100 in cross-section in FIG. 49, and the pistol 100 in cross-section with the left cam path 147 and trunnion 122 exposed in FIG. 55. Trigger 272 remains pulled and with slide assembly 150 partially returned towards an in battery configuration with a cartridge being stripped from magazine 210. As illustrated, cartridge cam 169 has impacted cartridge 99, thereby removing cartridge 99 from its position in magazine 210 with the tip of cartridge 99 riding along ramp 136 of barrel 131 and being guided into chamber 134 by ramp 136. Sear catch 246 is aligned with and spaced apart from striker catch 184 such that, with continued movement of slide assembly 150 towards an in battery position, striker catch 184 will abut and catch sear catch 246. Trigger bow assembly 270 remains pulled and tongue 304 still located below sear 242. Upon release of trigger 272 and shoulder 149 of barrel 131 abutting against face 161 due to continued movement of slide assembly 150 under the biasing force imparted by the now partially compressed recoil spring assembly 220, tongue 304 will be in position to re-engage sear 242 in notch 243 when trigger bar is returned to a neutral position by plunger 306. Continued forward movement will also complete stripping of cartridge 99 and loading of cartridge 99 into chamber 134. Barrel 131, with cam path 147 riding on trunnions 122 and 123, will return to the position illustrated in FIGS. 34, 44, and 50, completing a cycle of pistol 100.

Continued forward movement of slide assembly 150 relative to receiver 101 will bring face 161 into contact with shoulder 149, pushing barrel 131 forward with slide assembly 150. The outer surface of barrel 131 riding in aperture 156 and trunnions 122 and 123 riding on cam path 147 will return barrel 131 (with a new cartridge 99 positioned in chamber 134) to a horizontal position with shoulder 144 abutting takedown pin 230 as shown in FIGS. 7 and 34. The recoil spring assembly 220 is returned to the least compressed position, and the trunnions 122 and 123 are received in clearances 148 and are located behind recesses 146.

Figure 40:
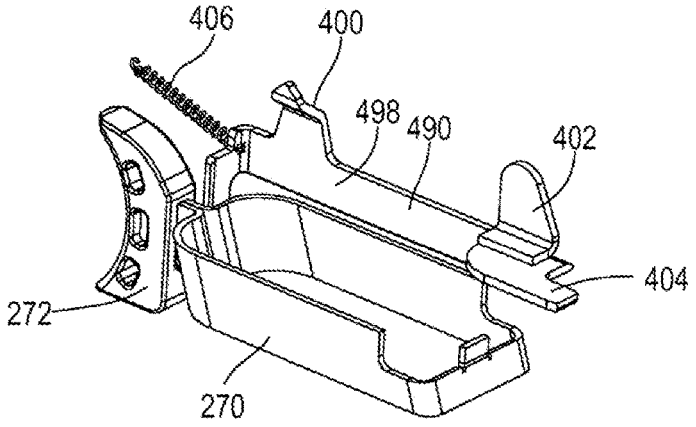
FIG. 40 is a perspective view of an alternative embodiment of the trigger bar of the current embodiment of the receiver of FIG. 8 with the trigger bow assembly.
Figure 41:
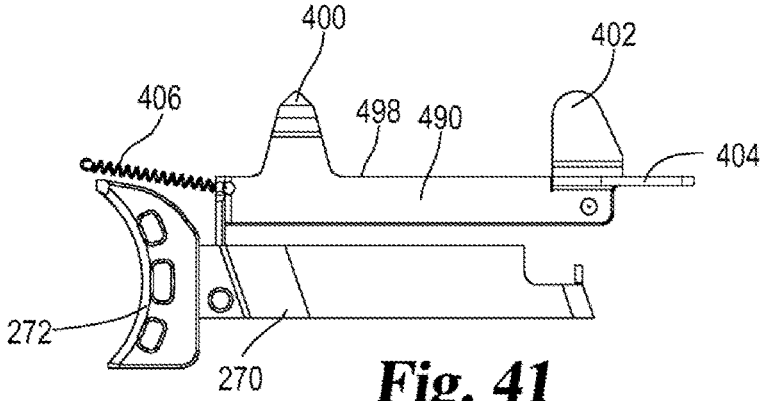
FIG. 41 is a left-side elevational view of the trigger bar of FIG. 40 with the trigger bow assembly.

Referring now to FIGS. 40 and 41, trigger bar 490 is illustrated with trigger bow assembly 270. Trigger bar 490 is an alternative embodiment of trigger bar 290. Trigger bar 490 may optionally be substituted for trigger bar 290 in pistol 100 as described above. Trigger bar 490 includes body 498, safety cam 400, sear reset cam 402, tongue 404 and spring 406. Trigger bow assembly 270 is the same as the trigger bow assembly described above and includes trigger 272.

The primary difference between trigger bar 490 and trigger bar 290 is the inclusion of spring 406 with trigger bar 490. The free end of spring 406 is coupled to frame 102 (not illustrated) while the other end is coupled to trigger bar 490 as illustrated. Spring 406 provides a biasing force that tends to pivot tongue 404 upwardly, in the same way plunger 306 biases tongue 304 upwardly into contact with notch 243 in sear 242. In an alternative embodiment, spring 406 can be replaced by a torsion spring.

Plunger 306 may optionally be included with a pistol that includes trigger bar 490 or plunger 306 may optionally be omitted. Spring 406 can be utilized to provide additional biasing force in conjunction with plunger 306 or spring 406 may provide all of the biasing force that biases tongue 404 upwardly into contact with notch 243 in sear 242.

Figure 42:
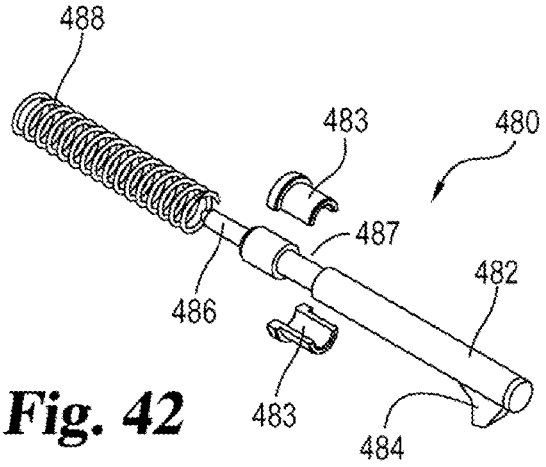
FIG. 42 is an exploded perspective view of an alternative embodiment of the striker assembly of the current embodiment of the slide barrel assembly of FIG. 23.

FIG. 42 illustrates the improved striker assembly 480 of the present invention. More particularly, striker assembly 480 is an alternative embodiment of striker assembly 180 and may optionally be substituted for striker assembly 180 in pistol 100 described above. Striker assembly 480 includes striker 482, split shoulders 483 and spring 488. Striker 482 defines recess 487 and firing pin 486. Striker assembly 480 is assembled with spring 488 positioned over striker 482 and forward of recess 487. Split shoulders 483 are then placed opposite each other in recess 485 and spring 488 is released to cover portions of split shoulders 483, restraining split shoulders 483 in recess 485.

When removed from pistol 100, striker assembly 480 may stay together as a unitary piece, with spring 488 restrained between split shoulders 483 and striker 484. Conversely, when striker assembly 180 is removed from pistol 100, striker 182, spring 188 and firing pin 186 generally separate as independent components. Striker assembly 480 may help reduce lost parts when stripping pistol 100.

Figure 43:
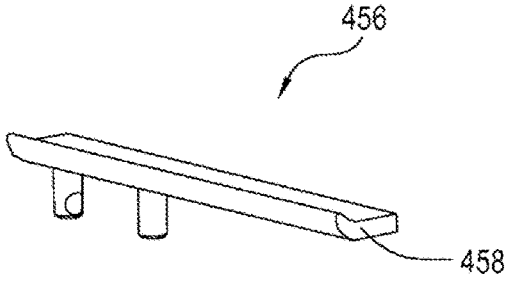
FIG. 43 is a perspective view of an alternative embodiment of the ejector of the current embodiment of the sear assembly of FIG. 17.

FIG. 43 illustrates the improved ejector 456 of the present invention. More particularly, ejector 456 is an alternative embodiment of ejector 256 and may optionally be substituted for ejector 256 in pistol 100 described above. Ejector 456 can be attached to sear block 248 to position ejector tip 458 to impact expended brass cases being extracted from chamber 134 to help eject them from pistol 100 as is known in the art. Ejector 456 may have a lower mass than ejector 256.

Several biasing devices are described with regard to pistol 100 including springs 188, 200, 254, 282, 328 and 346 and plunger 306. "Biasing" device is used to describe these types of elements in the claims below. "Biasing" device should be understood as incorporating any type of device that stores and releases mechanical energy, not just the mechanical springs illustrated in the figures.

In the context of the specification, the term "left-side" means the left side of the shooter who is holding the pistol in their hand and pointing at a target away from the shooter. "Right-side" means the right side of the shooter holding the pistol as described above. "Front" means the point of view of the target of the pistol (barrel end). "Back" means the view of a shooter holding the pistol as described above (grip end). "Top" and "bottom" reference an orientation where the shooter holds the pistol vertically (in a gravitational orientation), with the barrel above the magazine.

To describe motion of the slide and barrel assembly of the disclosed pistol, motion of the slide toward the shooter (toward the "back" of the pistol, as defined above) is described herein as "rearward" motion while motion of the slide and barrel assembly away from the shooter, toward a target (toward the "front" of the pistol, as defined above) is described herein as "forward" motion. These relative positioning terms such as "top," "up," "down," "bottom," "above," "below" and "under" are used to describe the relative position of components and the orientation of elements. These terms are not intended to be limiting relative to a gravitational orientation or an orientation of the disclosed pistol as held by a shooter. Relative positioning terms should be understood only in reference to the relative position shown in the drawings and the position of various components relative to each other and relative to the frame of reference described above.

While a current embodiment of a semi-automatic pistol has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, while semi-automatic pistols as described are the most likely contemplated application for the concepts of the present invention, it should be appreciated that the current invention could be used with automatic pistols as well. Also, any energy absorbing or dissipating device for absorbing the energy of recoil, including a gas delayed or roller delayed mechanism, may be used instead of the recoil spring described. Furthermore, a fixed barrel or rotational barrel may be used instead of the barrel described that initially translates rearwardly and subsequently rotates. In addition, the plunger and extension spring described may be replaced by a leaf spring, and a rectangular recoil spring may be used instead of the helical recoil spring described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A firearm comprising:

a frame including a trigger guard having a downwardly facing upper surface defining a trigger finger space;

a selectively removable barrel connected to the frame and defining a center line axis, the barrel further comprising recesses with cam channels that are defined in a pair of opposed lateral side portions of the rear/breech portion of the barrel, and have a vertical floor surface spaced apart from a medial plane of the barrel, such that the barrel wall thickness is maintained above a preselected dimension proximate to the cam channels;

a slide connected to the frame and operable to reciprocate along the center line axis between a forward battery position and a rearward open position;

a recoil mechanism operably connected between the slide and the frame, and operable to bias the slide to the battery position, the recoil mechanism further comprising a bore receiving a guide rod and defining a guide rod axis, wherein the guide rod axis is below the upper surface of the trigger space; and the recoil mechanism being entirely below the upper edge of the frame and encapsulated entirely by the frame forward of the trigger guard.

2. The firearm of claim 1 wherein the recoil mechanism is a spring.

3. The firearm of claim 1, further comprising a selectively removable takedown pin abutting the barrel forward of the trigger guard and positioned to selectively retain the selectively removable barrel from being removed when the takedown pin is in position.

4. A firearm comprising:

a frame having a trigger guard defining a trigger finger space;

wherein the frame has a trigger defining a horizontal trigger plane vertically centered in a trigger guard;

wherein the frame has a forward lower surface forward of the trigger guard and positioned at a level below the trigger plane; and a selectively removable barrel connected to the frame and defining a bore axis, the barrel further comprising recesses with cam channels that are defined in a pair of opposed lateral side portions of the rear/breech portion of the barrel, and have a vertical floor surface spaced apart from a medial plane of the barrel, such that the barrel wall thickness is maintained above a preselected dimension proximate to the cam channels;

a slide connected to the frame and operable to reciprocate along the bore axis between a forward battery position and a rearward open position;

a recoil mechanism operably connected between the slide and the frame, and operable to bias the slide to the battery position; and the recoil mechanism being entirely below the barrel and forward of the trigger finger space.

5. The firearm of claim 4 further comprising a selectively removable takedown pin abutting the barrel forward of the trigger guard and positioned to selectively retain the barrel from being removed when the takedown pin is in position.

6. The firearm of claim 4 wherein the forward lower surface is positioned at a level above a bottom portion of the trigger guard by less than 0.25 inch.

7. A firearm comprising:

a frame including a trigger guard having a downwardly facing upper surface defining a trigger finger space;

a selectively removable barrel connected to the frame and defining a center line axis, the barrel further comprising recesses with cam channels that are defined in a pair of opposed lateral side portions of the rear/breech portion of the barrel, and have a vertical floor surface spaced apart from a medial plane of the barrel, such that the barrel wall thickness is maintained above a preselected dimension proximate to the cam channels;

a selectively removable takedown pin abutting the barrel forward of the trigger guard and positioned to selectively retain the selectively removable barrel from being removed when the takedown pin is in position;

a slide connected to the frame and operable to reciprocate along the center line axis between a forward battery position and a rearward open position;

a recoil mechanism operably connected between the slide and the frame, and operable to bias the slide to the battery position, the recoil mechanism further comprising a bore receiving a guide rod and defining a guide rod axis, wherein the guide rod axis is below the upper surface of the trigger space; and the recoil mechanism being entirely below the upper edge of the frame and encapsulated entirely by the frame forward of the trigger guard.

* * * * *